US007111879B2

(12) United States Patent
Zweibohmer et al.

(10) Patent No.: US 7,111,879 B2
(45) Date of Patent: Sep. 26, 2006

(54) LATCH ASSEMBLY FOR MOVABLE CLOSURE ELEMENT

(75) Inventors: Dennis J. Zweibohmer, Ionia, IA (US); Christopher M. Lane, Nashua, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/316,358

(22) Filed: Dec. 11, 2002

(65) Prior Publication Data

US 2004/0113440 A1 Jun. 17, 2004

(51) Int. Cl.
*E05B 3/00* (2006.01)

(52) U.S. Cl. ..... 292/336.3; 292/347

(58) Field of Classification Search ..... 292/336.3, 292/347, 93

See application file for complete search history.

(56) References Cited

U.S. PATENT DOCUMENTS

| | | | | |
|---|---|---|---|---|
| 3,897,092 | A * | 7/1975 | Atkins | 292/92 |
| 3,973,794 | A * | 8/1976 | Green | 292/254 |
| 4,225,163 | A * | 9/1980 | Hubbard et al. | 292/21 |
| 4,569,547 | A * | 2/1986 | Fayerman et al. | 292/347 |
| 4,895,399 | A * | 1/1990 | Horgan, Jr. | 292/92 |
| 5,054,825 | A * | 10/1991 | Mangin et al. | 292/92 |
| 5,246,054 | A * | 9/1993 | Shepherd et al. | 160/133 |
| 5,460,419 | A * | 10/1995 | Castoldi | 292/336.3 |
| 5,547,235 | A * | 8/1996 | Dziuk et al. | 292/92 |
| 5,655,798 | A * | 8/1997 | Kaveney et al. | 292/3 |
| 6,322,006 | B1 * | 11/2001 | Guo | 239/532 |
| 6,322,113 | B1 * | 11/2001 | Ayers et al. | 292/336.3 |
| 6,419,284 | B1 | 7/2002 | Kutschat | |
| 6,640,593 | B1 | 11/2003 | Hannah et al. | |
| 2003/0211922 | A1 * | 11/2003 | Piccolo | 492/13 |

FOREIGN PATENT DOCUMENTS

| | | |
|---|---|---|
| EP | 374 350 A1 | 6/1990 |
| GB | 1666529 | 12/1967 |
| GB | 1226372 | 3/1971 |

* cited by examiner

*Primary Examiner*—Gary Estremsky
(74) *Attorney, Agent, or Firm*—Wood, Phillips, Katz, Clark & Mortimer

(57) ABSTRACT

A latch assembly kit including a latching subassembly for mounting upon a movable closure element, an actuating assembly, a first elongate graspable handle, and a second elongate graspable handle. The latching subassembly has a latched state, wherein the latching subassembly releasably engages a strike element to maintain the movable closure element in a desired position relative to a support to which the movable closure element is attached, and a release state. The actuating assembly has a normal state and a release state. The actuating assembly causes the latching subassembly to change from its latched state into its release state as an incident of the actuating assembly changing from its normal state into its release state. The first elongate graspable handle has a first length and is releasably operatively connectable to at least one of the latching subassembly and actuating assembly to facilitate repositioning of the movable closure element upon which the latching subassembly is mounted. The second elongate graspable handle has a second length different than the first length and is releasably operatively connectable to at least one of the latching subassembly and actuating assembly in place of the first elongate graspable handle to facilitate repositioning of the movable closure element upon which the latching subassembly is mounted. The first and second elongate graspable handles can be selectively operatively connected to the at least one of the latching subassembly and actuating assembly to select a desired length of graspable handle, to facilitate repositioning of the movable closure element upon which the latching subassembly is mounted.

57 Claims, 20 Drawing Sheets

LATCH ASSEMBLY FOR MOVABLE CLOSURE ELEMENT

BACKGROUND OF THE INVENTION

1. Field of the Invention

This invention relates to latch assemblies for releasably maintaining movable closure elements in a desired position relative to a support therefor.

2. Background Art

Myriad designs for latch assemblies for maintaining movable closure elements in a desired position relative to a support upon which the movable closure element is mounted have been devised over the years. Different demands are placed upon these mechanisms depending upon their particular environment. However, designers of these latch assemblies universally consider and balance the following factors in their designs: 1) reliability; 2) holding capacity; 3) convenience of operation; 4) ease of manufacture; 5) ease of assembly; 6) versatility; and 7) cost. Certain of the above factors are competing in the design process and, generally, particular applications will dictate where compromises must be made. Ideally, one would optimize each of these design areas.

The agricultural and construction industries are ones in which rather severe demands are placed upon latch assemblies. Severe stresses are commonly placed on closure elements on cabs of tractors and the like. At the same time, convenience of actuation is a prime consideration, as when a hasty exit must be made from such a vehicle. This has lead to the use of squeeze-actuated assemblies of the type shown in U.S. Pat. No. 6,419,284. The squeeze actuator is integrated into a handle/bar which facilitates manipulation of the closure element as well as accessibility to the lever that is squeezed while gripping the bar to release the latch assembly to permit opening of the closure element. However, the latch assembly designs, of the type shown in U.S. Pat. No. 6,419,284, have tended towards the complicated. For example, the design shown in U.S. Pat. No. 6,419,284 uses two separate, indirect mechanisms for moving a catch element through separate internal and external actuating assemblies on the closure element. This indirect actuation requires intermediate parts which may complicate the manufacturing process and increase associated costs. Indirect mechanisms, by their nature, introduce additional parts movement that could account for a field failure.

The bars on the latch assemblies, of the type shown in U.S. Pat. No. 6,419,284, commonly have a crimped end which is bolted to the associated closure element. The particular closure element generally dictates the optimal length for the bar. Consequently, there may be a requirement to inventory complete latch assemblies with different lengths of bar to meet various demands. Manufacturing costs associated with this type of latch assembly may be increased by reason of having to offer the latch assemblies with different lengths of bar integrated thereinto. Further, if manufacturing does not proceed on an as-needed basis, inventories must be set up to anticipate demand. To avoid shortages for latch assemblies with a particular bar length, excess inventory may have to be kept on hand. This potentially adds inconvenience and expense for the purveyors of this type of latch assembly.

Another problem with the above type of latch assemblies is that it may be a difficult or complicated process to integrate components into the bars. The bars are typically tubes with internal hollows within which some of the components are situated. Ideally, components are mounted within the tubular hollows to afford a compact design, yet without requiring intricate assembly processes which increase costs. This has led to the use of separable components which engage the bars to facilitate assembly. For example, as seen in U.S. Pat. No. 6,419,284, a significant number of components are assembled through the opening which receives the actuating handle. The actuating handle itself is a separate component that must be attached to the bar and adjusted on site. A relatively large number of component assembly steps may be required to manufacture this latch assembly.

Still further, this type of latch assembly is commonly operated using cables or rods to transmit the operating force from the actuating handle to the latching mechanism. The use of intermediate rods and cables may account for a less than positive force transmission between the actuating handle and the latching structure. This type of mechanism also generally requires the capability to effect adjustments of the position of the actuating handle relative to the latching mechanism for optimal performance and to accommodate variations in the structures on which the latching assemblies are mounted. The result is that these mechanisms may become relatively expensive to manufacture, complicated, less compact and streamlined than desired, and prone to failure. Further, this type of latch mechanism may be installed so that the operator components are exposed to the operation and unsightly.

The industry is constantly seeking out latch assemblies that are improved in one or more of the areas noted above.

SUMMARY OF THE INVENTION

In one form, the invention is directed to a latch assembly kit including a latching subassembly for mounting upon a movable closure element, an actuating assembly, a first elongate graspable handle, and a second elongate graspable handle. The latching subassembly has a latched state, wherein the latching subassembly releasably engages a strike element to maintain the movable closure element in a desired position relative to a support to which the movable closure element is attached, and a release state. The actuating assembly has a normal state and a release state. The actuating assembly causes the latching subassembly to change from its latched state into its release state as an incident of the actuating assembly changing from its normal state into its release state. The first elongate graspable handle has a first length and is releasably operatively connectable to at least one of the latching subassembly and actuating assembly to facilitate repositioning of the movable closure element upon which the latching subassembly is mounted. The second elongate graspable handle has a second length different than the first length and is releasably operatively connectable to at least one of the latching subassembly and actuating assembly in place of the first elongate graspable handle to facilitate repositioning of the movable closure element upon which the latching subassembly is mounted. The first and second elongate graspable handles can be selectively operatively connected to the at least one of the latching subassembly and actuating assembly to select a desired length of graspable handle, to facilitate repositioning of the movable closure element upon which the latching subassembly is mounted.

In one form, the first elongate graspable handle is a tubular element.

The first and second elongate graspable handles each have spaced first and second ends. The first ends are each operatively connectable to the at least one of the latching subassembly and actuating assembly. In one form, the kit further includes a fitting which is connectable to the movable closure element upon which the latching subassembly is mounted and operatively connectable to the second ends of the first and second elongate graspable handles.

The fitting may be elbow-shaped.

In one form, the fitting has a flange to engage and be secured to the movable closure element upon which the latching subassembly is mounted and a connecting portion which is engageable with connecting portions on the second ends of the first and second elongate graspable handles.

The connecting portion on the fitting and the connecting portions on the first and second elongate graspable handles may be connectable through a telescoping arrangement.

In one form, the connecting portion on the fitting and the connecting portions on the first and second elongate graspable handles are maintainable, telescopingly engaged, one within the other, by a threaded fastener.

In one form, the actuating assembly has a trip lever that is movable between a normal position and a release position to change the actuating assembly from its normal state into its release state.

The trip lever may be attached directly to the latching subassembly.

In one form, the trip lever is pivotable between its normal and release positions.

The latching subassembly may be operable independently of the first and second elongate graspable handles.

In one form, the first elongate graspable handle has a slot formed therein to receive the trip lever.

The trip lever may be slidable through the slot from the first end of the first elongate graspable handle towards the second end of the first elongate graspable handle.

In one form, the first elongate graspable handle is tubular with an internal hollow and the trip lever resides partially within the internal hollow.

In one form, the trip lever has a projecting tab which abuts to the first elongate graspable handle within the internal hollow to limit pivoting of the trip lever outwardly from the internal hollow.

The kit may further include a spring element acting between the first elongate graspable handle and trip lever to bias the trip lever towards its normal position wherein the projecting tab abuts to the first elongate graspable handle within the internal hollow.

In one form, the spring element is a leaf spring.

The leaf spring may be attached to the trip lever so that the trip lever and attached leaf spring can be slid through the first end of the first elongate graspable handle into an operative position wherein the leaf spring resides within the hollow and acts between the first elongate graspable handle and the trip lever so that the trip lever is urged by the leaf spring towards it normal position.

In one form, the latching subassembly has a housing and a rotor movable relative to the housing selectively between a latched position and a release position. The first rotor releasably engages a strike element with the rotor in the latched position.

In one form, the latching subassembly has a housing with spaced walls bounding a space and a rotor within the space for releasably engaging the strike element. The kit may further include a bracket which defines at least a part of one of the walls bounding the space. One of the spaced ends of the first and second elongate graspable handles is attachable directly to the bracket.

The trip lever may be directly connected to the bracket for guided pivoting movement between its normal and release positions.

In one form, the bracket has one piece that defines the at least part of the one of the walls bounding the space and to which the trip lever and the one of the spaced ends of the first and second elongate graspable handles directly attach.

In one form, the kit further includes a protective shroud that is releasably placed over at least a part of the latching subassembly and the actuating assembly.

The invention contemplates the above latch kit assembly in combination with a movable closure element to which the latching subassembly is mounted.

The invention is further directed to a latch assembly for a movable closure element. The latch assembly has a latching subassembly for mounting upon a movable closure element, an actuating assembly, and an elongate graspable handle. The latching assembly has a latched state, wherein the latching subassembly releasably engages a strike element to maintain the movable closure element in a desired position relative to a support to which the movable closure element is attached, and a release state. The actuating assembly has a normal state and a release state. The actuating assembly causes the latching subassembly to change from its latched state into its release state as an incident of the actuating assembly changing from its normal state into its release state. The elongate graspable handle is connected to at least one of the latching subassembly and actuating assembly to facilitate repositioning of the movable closure element upon which the latching assembly is mounted. The actuating assembly has a trip lever that is attached to the latching subassembly for movement between normal and release positions.

In one form, the trip lever is pivotable between its normal and release positions.

The elongate graspable handle may be a tubular element.

In one form, the elongate graspable handle has spaced first and second ends. The first end of the elongate graspable handle is connected to the at least one of the latching subassembly and actuating assembly. The kit may further include a fitting which is connectable to the movable closure element upon which the latching subassembly is mounted and operatively connected to the second end of the elongate graspable handle.

In one form, the fitting is elbow-shaped.

The fitting may have a flange to engage and be secured to the movable closure element upon which the latching subassembly is mounted and a connecting portion which engages a connecting portion on the second end of the elongate graspable handle.

The connecting portion on the fitting and the connecting portion on the elongate graspable handle may be connected through a telescoping engagement.

In one form, the connecting portion on the fitting and the connecting portion on the elongate graspable handle are maintainable, telescopingly engaged, one within the other, by a threaded fastener.

In one form, the actuating assembly is in the form of a trip lever that is movable between a normal position and a release position to change the actuating assembly from its normal state into its release state.

The trip lever may be attached directly to the latching subassembly.

In one form, the trip lever is pivotable between its normal and release positions.

In one form, the latching subassembly is operable independently of the elongate graspable handle.

In one form, the elongate graspable handle has a slot formed thereon to receive the trip lever.

The elongate handle has spaced first and second ends. In one form, the trip lever is slidable through the slot from the first end of the elongate graspable handle towards the second end of the elongate graspable handle.

In one form, the elongate graspable handle is tubular with an internal hollow, with the trip lever residing partially within the internal hollow.

In one form, the trip lever has a projecting tab which abuts to the elongate graspable handle within the internal hollow to limit pivoting of the trip lever outwardly from the internal hollow.

The kit may further include a spring element acting between the elongate graspable handle and trip lever to bias the trip lever towards its normal position wherein the projecting tab abuts to the elongate graspable handle within the internal hollow.

In one form, the spring element is a leaf spring.

The leaf spring may be attached to the trip lever so that the trip lever and attached leaf spring can be slid through the first end of the elongate graspable handle into an operative position wherein the leaf spring resides within the hollow and acts between the elongate graspable handle and the trip lever so that the trip lever is urged by the leaf spring towards its normal position.

In one form, the latching subassembly has a housing and a rotor movable relative to the housing selectively between a latched position and a release position. The rotor releasably engages the strike element with the rotor in its latched position.

In one form, the latching subassembly has a housing with spaced walls bounding a space and a rotor within the space for releasably engaging a strike element. The kit may further include a bracket which defines at least a part of one of the walls bounding the space. The elongate graspable handle has spaced ends, with one of the spaced ends attached directly to the bracket.

In one form, the trip lever is connected directly to the bracket for guided pivoting movement between its normal position and its release position.

In one form, the bracket has one piece that defines at least part of one of the walls bounding the space and to which the trip lever and the one of the spaced ends of the first elongate graspable handle directly attach.

The kit may further include a protective shroud that is releasably placed over at least a part of the latching subassembly and the actuating assembly.

The latch assembly described above may be provided in combination with a movable closure element to which the latching subassembly is mounted.

DETAILED DESCRIPTION OF THE DRAWINGS

Figure 1:
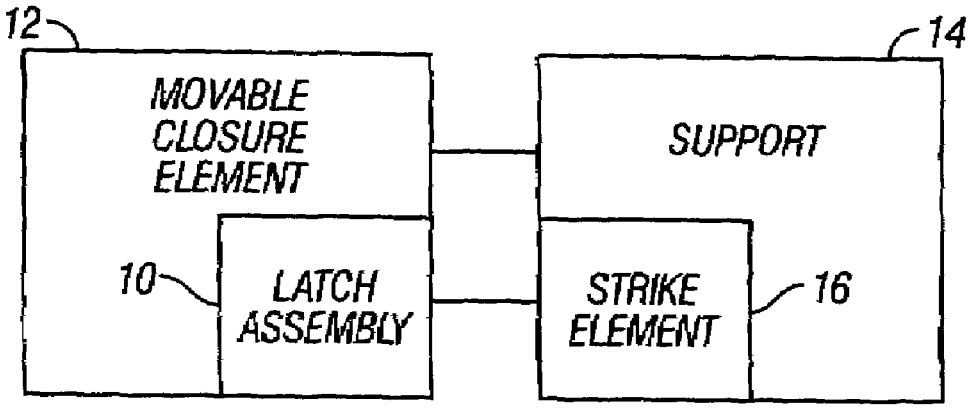
FIG. 1 is a schematic representation of a system including a latch assembly, according to the present invention, mounted upon a closure element which is movable relative to a support and which coacts with a strike element on the support to maintain the closure element in a desired position.

Referring initially to FIG. 1, a latch assembly 10, according to the present invention, is shown on a closure element 12 mounted upon a support 14. The closure element 12 is selectively movable relative to the support 14 between different positions. The latch assembly 10 cooperates with a strike element 16 on the support 14 to releasably maintain the movable closure element 12 in a desired position. The inventive latch assembly 10 is shown in a generic form in FIG. 1 since it can be used on virtually any type of movable closure element in any type of environment. One representative environment for the latch assembly 10 is upon a movable closure element 12 such as an access door, on a support 14 in the form of a piece of agricultural or construction equipment, such as a tractor. However, the latch assembly 10 can be used in other dynamic and static environments, with the operation thereof being substantially the same in each.

Figure 2:
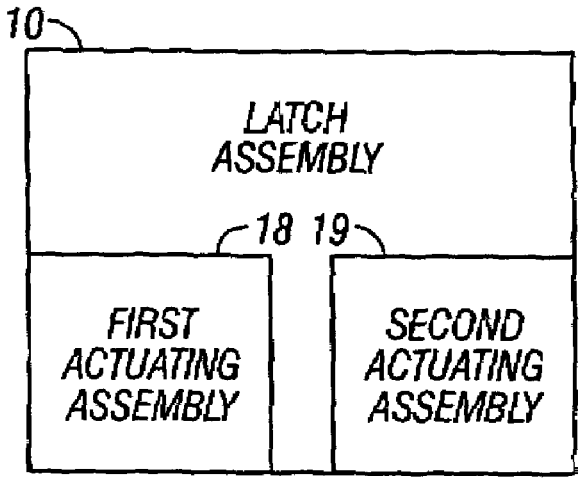
FIG. 2 is a schematic representation of the inventive latch assembly in FIG. 1 and showing first and second separate actuating assemblies therefor.
Figure 3:
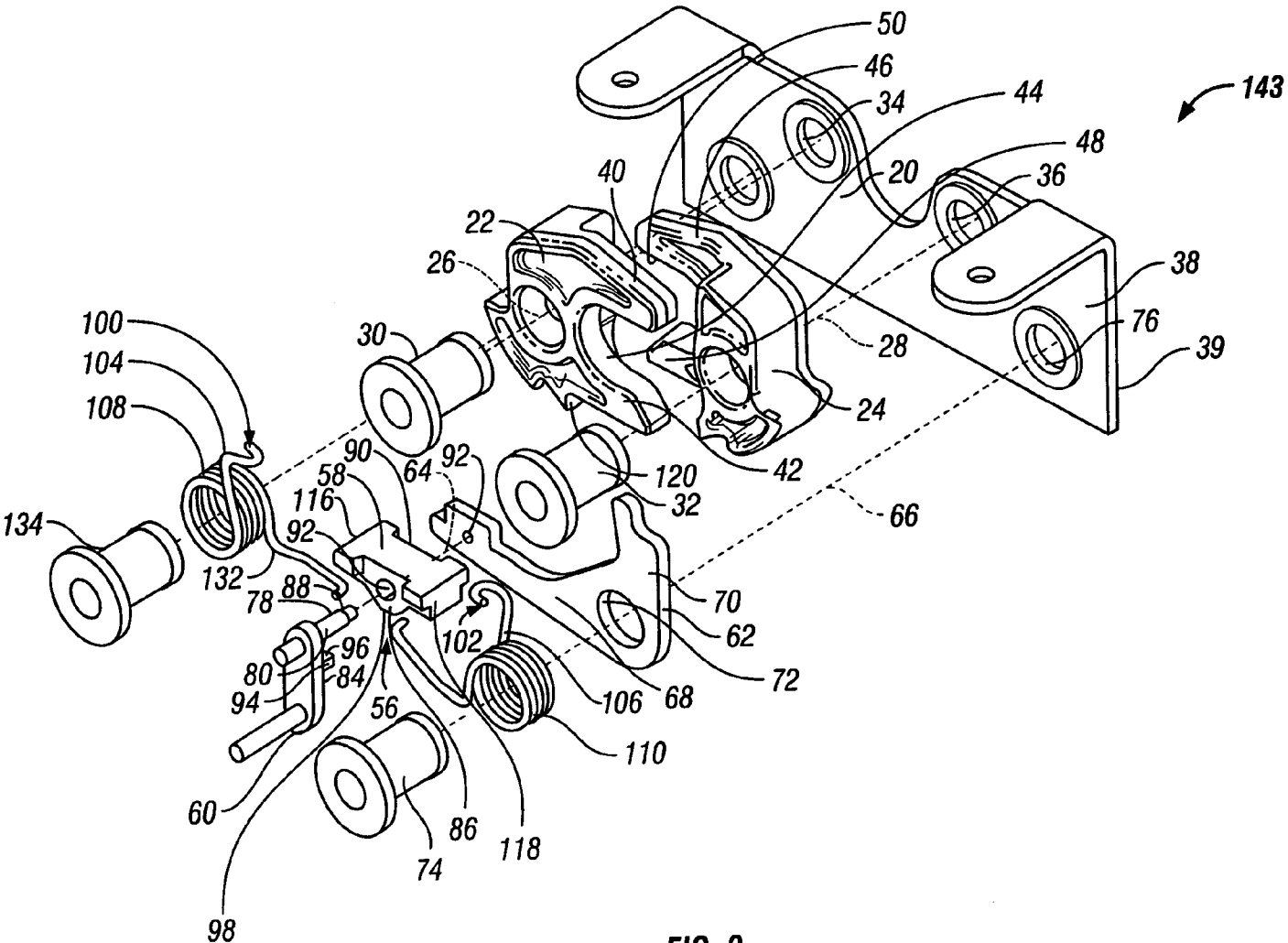
FIG. 3 is an exploded, perspective view of a latching subassembly on the latch assembly, according to the present invention, and including a pair of pivoting rotors.

As shown in FIG. 2, the latch assembly 10 is operable by first and second actuating assemblies 18, 19 provided on opposite sides of the movable closure element 12 for independent interior and exterior operation of the latch assembly 10. The first and second actuating assemblies 18, 19 will be described herein in one form. However, it should be understood that both of the actuating assemblies 18, 19 could have a substantially different form than the exemplary forms described herein.

The first and second actuating assemblies 18, 19 are part of an overall operating assembly which is responsible for causing the latch assembly 10 to release the strike element 16 to permit repositioning of the movable closure element 12 from a particular position therefor that is maintained with the latch assembly 10 holding the strike element 16. More particularly, as shown in FIGS. 3–7, the latch assembly 10 has a housing 20 to which a pair of cooperating rotors 22, 24 are mounted for pivoting movement about parallel axes 26, 28, respectively. The rotors 22, 24 may have the same construction, as shown, or a different construction. The rotors 22, 24 are mounted on the housing by axles 30, 32, which extend through openings 34, 36 in a housing wall 38 and are fixed by being deformed at an outer surface 39 of the wall 38. The rotors 22, 24 are journalled for rotation, one each, around the axles 30, 32.

The rotor 22 has a U-shaped free end with projecting legs 40, 42, which bound a throat 44. The rotor 24 has corresponding legs 46, 48 bounding a throat 50. The rotors 22, 24 are mounted upon the axles 30, 32 so as to cooperate in a scissors-type action as they each move between a release position, shown in FIG. 4, and a primary latched position, as shown in FIGS. 3 and 5–7. With the rotors 22, 24 in the release position of FIG. 4, movement of the rotors 22, 24 against the strike element 16, as by repositioning of the movable closure element 12, causes the strike element 16 to be directed in the direction of the arrow 51 in FIG. 4. The strike element 16 progressively cams the rotors 22, 24 so that they are pivoted in the direction of the arrows 52, 53 about their axes 26, 28, respectively. Continued movement of the strike element 16 against the rotors 22, 24 causes the legs 40, 42, 46, 48 to cooperatively fully surround an opening 54 within which the strike element 16 becomes captive with the rotors 22, 24 in their primary latched positions.

The rotors 22, 24 are maintained in their primary latched positions by a catch block assembly at 56 consisting of a catch block 58 and an adaptor 60, attached thereto and performing a function as hereinafter described. The catch block 58 is mounted to an L-shaped catch arm 62 for pivoting movement about an axis 64. The catch arm 62 is in turn mounted to the housing 20 for pivoting movement around an axis 66. The catch arm 62 has long and short legs 68, 70 at the juncture of which an opening 72 is formed to received a mounting axle 74 which is mounted in an opening 76 in the housing 20 and deformed where it is exposed at the surface 39 so as to be fixed thereto.

The adaptor 60 has a post 78 with a stepped diameter. A larger diameter portion 80 of the post 78 is guided within a bore 82 through the catch block 58. With a flat surface 84 at the base of the post 78 abutting to a surface 86 on the catch block 58, a reduced diameter portion 88 of the post 78 projects beyond the catch block surface 90 facing oppositely to the surface 86, and fixedly into a bore 92 adjacent to the free end of the long leg 68 of the catch arm 62. The adaptor 60 has a tab 94 projecting in the same direction as the post 78 from the adaptor surface 84 and having an upwardly facing surface 96 which bears on a flat, downwardly facing surface 98 on the catch block 58 so as to prevent pivoting movement of the adaptor 60 relative to the catch block 58. Resultingly, the adaptor 60 and catch block 58 move together as one piece in operation.

The rotors 22, 24 are biased about their respective axes 26, 28 by free ends 100, 102 of projecting arms 104, 106 on coil torsion springs 108, 110. The free end 100 of the spring 108 continuously exerts a bias on a shoulder 112 on the rotor 22, thereby urging the rotor 22 in a counterclockwise direction around the axis 26 in FIG. 4 towards the release position. The arm 102 on the spring 110 acts in like manner on a shoulder 114 on the rotor 24 to urge the rotor 24 in a clockwise direction about its axis 28 in FIG. 4 towards its release position.

Figure 4:
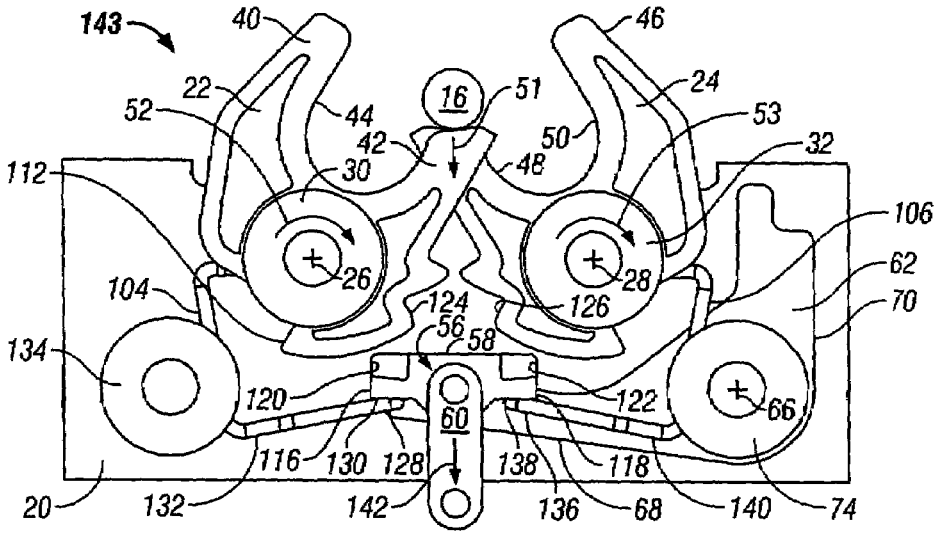
FIG. 4 is side elevation view of the latching subassembly in FIG. 3 with the rotors in a release position.
Figure 5:
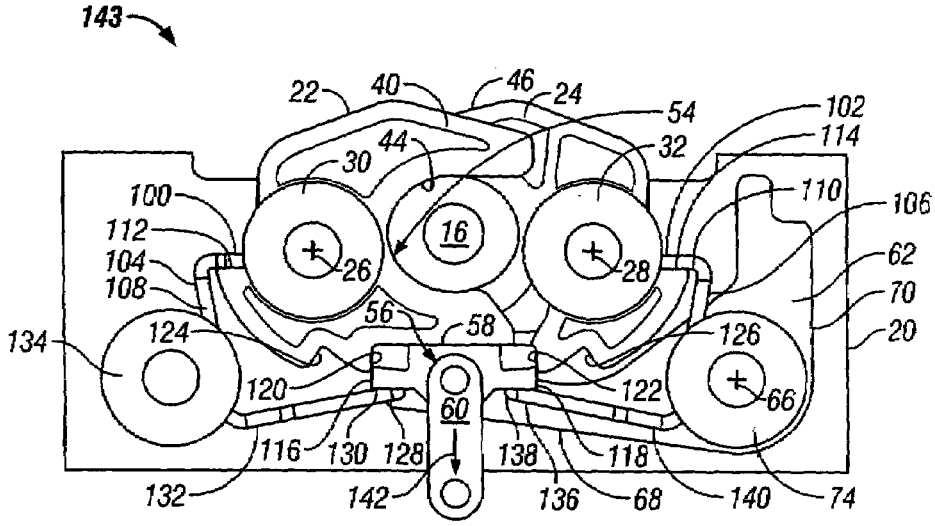
FIG. 5 is a view as in FIG. 4 with the rotors in a latched position.

The rotors 22, 24 are maintained in their primary latched positions in FIG. 5 by oppositely facing catch block surface 116, 118, which bear bearing respectively on stop surfaces 120, 122 on the rotors 22, 24, respectively. Separate stop surfaces 124, 126 on the rotors 22, 24 bear against the catch block surfaces 116, 118 to maintain the rotors 22, 24 in a secondary latched position (not shown), which is between the primary latched position of FIG. 5 and the release position of FIG. 4.

The springs 108, 110 are also responsible for cooperatively bearing the catch block assembly 56 upwardly to against the rotors 22, 24. More specifically, the free end 128 of the spring 108 opposite to the free end 100 bears on a downwardly facing shoulder 130. The free end 128 is at the extremity of an arm 132 projecting from the coiled portion of the spring 108 which surrounds an axle 134. Similarly, the free end 136 of the spring 110, opposite to the free end 102 of the spring 110 bears upon a shoulder 138 on the catch block 58. The free end 136 is carried on an arm 140 projecting from the coiled portion of the spring 110 which is supported on the axle 74, which additionally guides pivoting movement of the catch arm 62.

Figure 6:
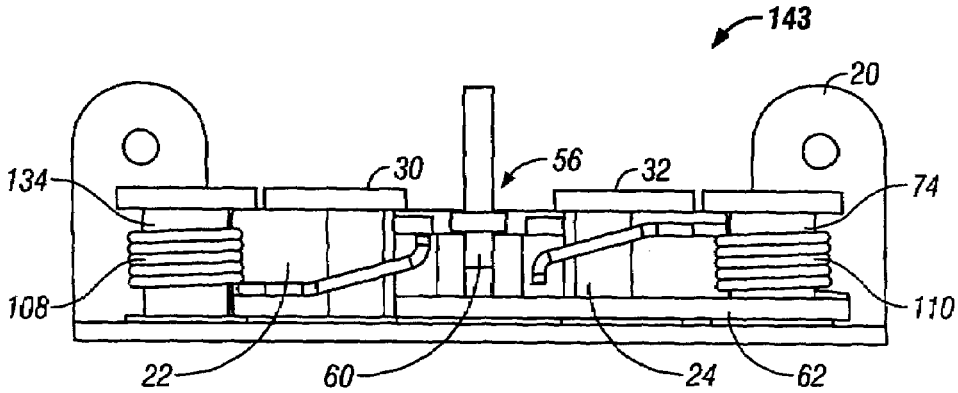
FIG. 6 is a front elevation view of the latching subassembly in FIG. 5.
Figure 7:
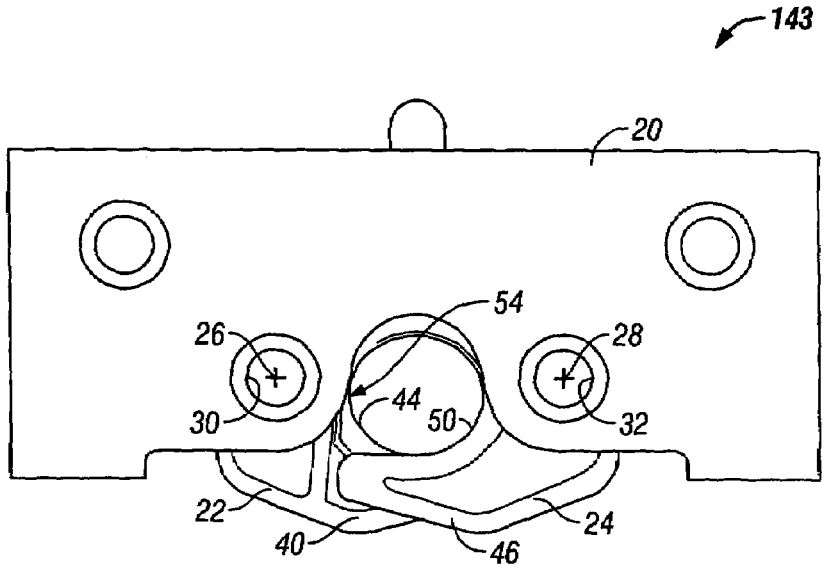
FIG. 7 is an inverted view of the latching subassembly from the side opposite that in FIG. 5.

In operation, with the rotors 22, 24 in their release position of FIG. 4, movement of the strike element 16 against the rotors 22, 24, by reason of repositioning of the movable closure element 12, cams the rotors 22, 24 simultaneously from the FIG. 4 release position towards the latched position of FIGS. 5–7. As this occurs, the catch block assembly 56 is urged against the moving rotor 22, 24 until the catch block assembly 56 aligns with the stop surfaces 124, 126 thereon. The movable closure element 12 can be maintained in the previously described, secondary latched position if the strike element 16 is not caused to be urged with any additional force against the rotors 22, 24. Continued movement of the closure element 12 ultimately causes the catch block assembly 56 to align with the stop surfaces 120, 122 and to be driven upwardly into confronting relationship therewith so that the rotors 22, 24 are each maintained in their primary latched positions.

When it is desired to reposition the movable closure element 12, the catch block assembly 56 has to be moved downwardly, in the direction of the arrow 142 (FIG. 5), until the catch block assembly 56 clears the stop surfaces 120, 122, whereupon the springs 108, 110 urge the rotors 22, 24 back towards their release positions. Because the catch block assembly 56 is allowed to pivot/float around the axis 64, the angular orientation of the catch block assembly 56 relative to the catch arm 62 can be consistently maintained as it is moved downwardly in the direction of the arrow 142. This avoids binding between the catch block 56 and rotors 22, 24.

The housing 20 and components mounted thereto, together define a latching subassembly 143. According to the invention, the operation of the latching subassembly 143, by repositioning of the catch block assembly 56, can be accomplished independently directly through either of the first and second actuating assemblies 18, 19, to thereby change the latching subassembly 143 from a latched state, wherein the rotors 22, 24 are in their latched positions, into a release state, wherein the rotors 22, 24 are in their release positions. The details of the first actuating assembly 18 are shown in FIGS. 8–17. The first actuating assembly 18 consists of a trip lever 144 which is mounted for pivoting movement relative to a mounting plate/bracket 146, that is fixed to the housing 20 through the axles 30, 32. The latching subassembly 143 and the first actuating assembly 18 are thus joined as a combined subassembly that can be assembled to, and disassembled from, the movable closure element 12 and the second operating assembly 19. The trip lever 144 has an elongate operating portion 148 at one end and is bifurcated at its opposite end to define spaced legs 150, 152 which are received between spaced ears 154, 156 on the mounting plate 146. The legs 150, 152 in turn straddle a trip latch 158. A pin 160 extends through the trip lever 144, trip latch 158, and the ears 154, 156 to maintain the same in operative relationship wherein the trip lever 144 and trip latch 158 are pivotable about a common axis 162 defined by the pin 160.

The trip latch 158 has a shoulder 164 which bears against a surface 166 defined by a post 168 that is a extension of the post 78 on the adaptor 60 through which the catch block 58 is mounted. The post 168 projects in cantilever fashion. By pivoting the trip latch 158 in a counterclockwise direction, as indicated by the arrow 170 in FIG. 16, the trip latch shoulder 164 bears against the post surface 166 and drives the catch block assembly 56 in the direction of the arrow 142 in FIGS. 5 and 16 from its engaged position into its disengaged position. The pivoting movement of the trip latch 158 is imparted by the trip lever 144 by pivoting the trip lever 144 about the pin 160 and its axis 162 in the same counterclockwise direction as indicated by the arrow 170 in FIG. 16. The trip latch 148 has side extensions 172, 174 which define shoulders 176, 178, respectively, which confront shoulders 180, 182 on the trip lever legs 150, 152, respectively. The shoulders 180, 182 on the trip lever 144 drive the shoulders 176, 178 to pivot the trip latch 158 as the trip lever 144 is pivoted by the operator. The trip lever 144 and trip latch 158 could actually be formed to move as one piece to perform the function stated.

The trip lever 144, in this particular embodiment, is mounted so as to be operable by a squeezing force. More particularly, the operating portion 148 of the trip lever 144 is associated with a hollow, tubular, graspable handle 184 so that the handle 184 can be surrounded by a hand in such a manner as to permit grasping by the operator's fingers of the operating part 148 of the trip lever 144 and simultaneously the repositioning of the movable closure element 12 through the handle 184. The trip lever 144 is slid into a slot 186, originating at one end 188 of the handle 184. The slot 186 has a width W that is slightly greater than the width W1 of the operating part 148 of the trip lever 144. The slot length L is chosen so that the free end 190 of the trip lever 144, remote from the mounting legs 150, 152, can pass through the slot 186 as the trip lever 144 is pivoted in operation.

The trip lever 144 has oppositely projecting tabs 192 (one shown). The trip lever 144 is directed into the slot 186 so that the tabs 192 reside within the hollow 194 of the tubular handle 184. The tabs 192 effectively increase the width of the trip lever 144 thereat to a dimension that is greater than the width W. Accordingly, the trip lever 144 must be slid into the hollow 194 of the tubular handle 184 leading with the free end 190. The tabs 192 confine outward pivoting of the trip lever 144 relative to the handle 184.

A leaf spring 196 (FIG. 15) acts between the trip lever 144 and the inside surface 198 of the tubular handle 184 to normally urge the operating portion 148 of the trip lever 144 out of the slot 186 into a normal position. With the user grasping the tubular handle 184 in the vicinity of the trip lever 144, the fingers can be wrapped around the exposed edge 200 of the trip lever 144 and drawn towards the palm in a squeezing action to move the trip lever 144 from a normal position into a release position, as shown in phantom lines in FIG. 15 corresponding to normal and release states for the first actuating assembly 18. As the trip lever 144 is moved from the normal position into the release position, the trip latch 158 is pivoted in turn to move the catch block assembly 56 from its engaged position into its disengaged position.

The tubular handle 184 is maintained in its operative position by directing a mounting bolt 202 through a bore 204 in a flange 206 on the mounting plate 146 and into a threaded receptacle 208 on a U-shaped spring clip 210 and which is maintained within the hollow 194 by sliding the U-shaped spring clip 210 over the tubular handle end 188.

The opposite end 212 of the tubular handle 184 is mounted to the closure element 12 through an elbow-shaped fitting 214. The fitting 214 has a male end connecting portion 216 which fits slidably within the hollow 194 at a female connecting portion 217 at the handle end 212. An annular shoulder 218 abuts to the handle end 212 with the fitting 214 fully seated. The fitting 214 has a flange 220 which seats on and projects from one side 222 of the movable closure element 12, in a direction away from the other side, and has a threaded bore 224 to accept a mounting bolt 226. A protective shroud 228, made of plastic, or the like, can be slid over the housing 20 and the components mounted thereto, i.e. the latching subassembly 143, the mounting plate 146, the trip latch 158, and the adjacent portions of the tubular handle 184 and trip lever 144. The shroud 228 has a slot 230 to accept the tubular handle 184 and an opening 232 through which the rotors 30, 32 are exposed to permit engagement with the strike element 16. The shroud 28 is maintained in its operative position by connection to the mounting plate 146 through screws 234 directed through oval openings 235 in the shroud which permit a degree of adjustment of the shroud position relative to the latching subassembly 143.

Figure 8:
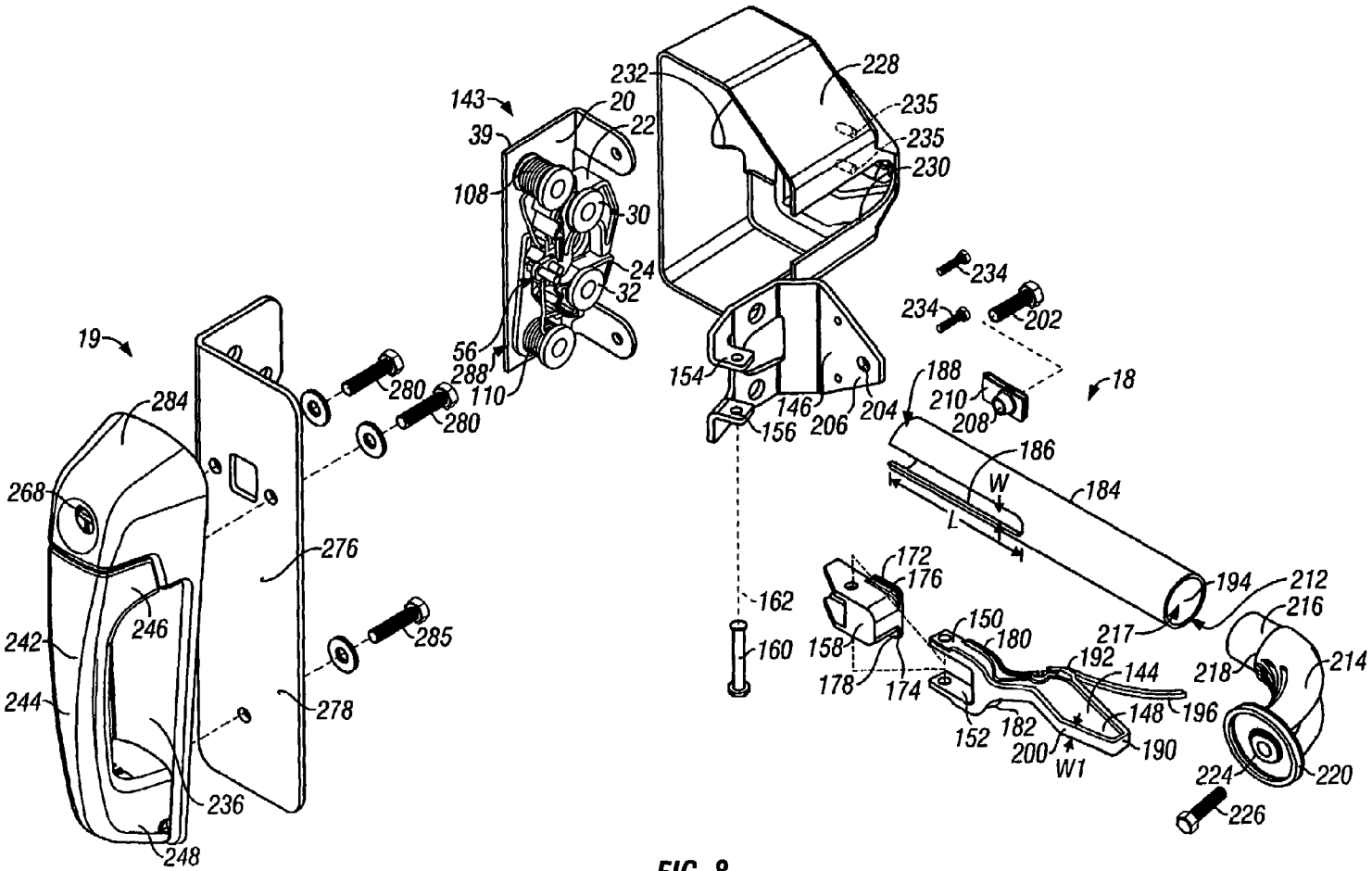
FIG. 8 is an exploded, perspective view of the inventive latch assembly including the latching subassembly and first and second actuating assemblies for operating the latching subassembly.
Figure 9:
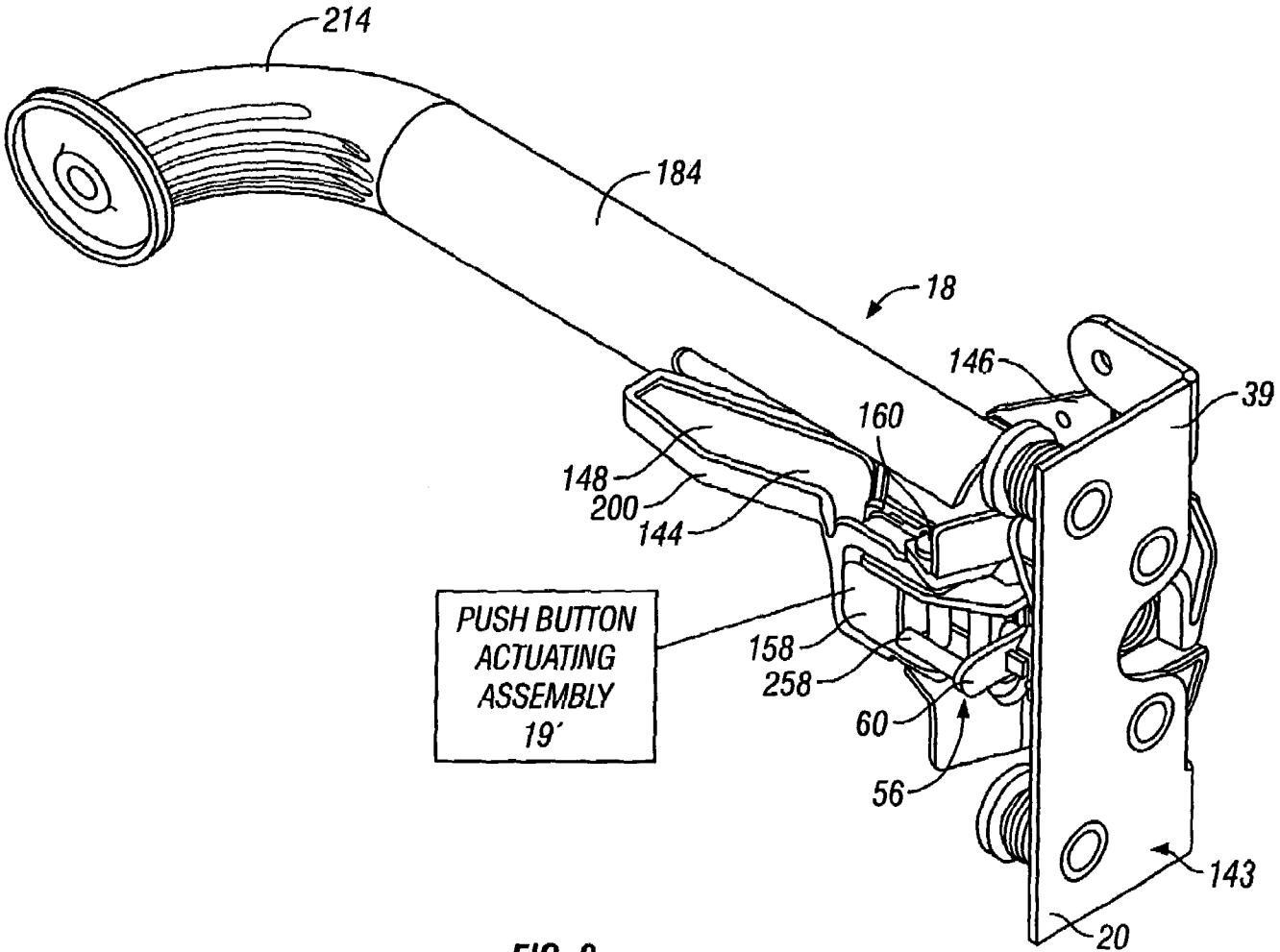
FIG. 9 is a rear perspective view of a combined subassembly including a first of the actuating assemblies in FIG. 8 and the latching subassembly in FIGS. 3–7.
Figure 10:
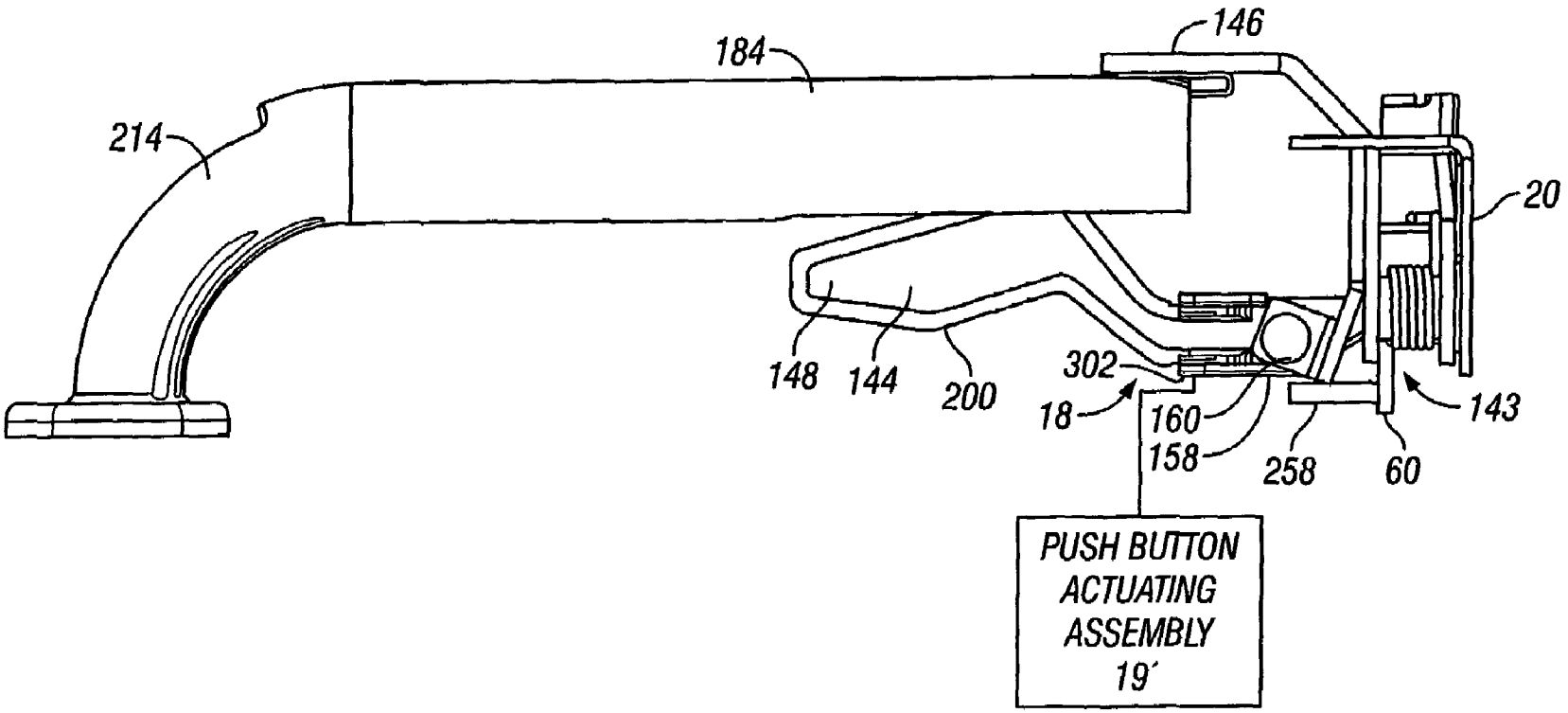
FIG. 10 is a plan view of the combined subassembly of FIG. 9.
Figure 11:
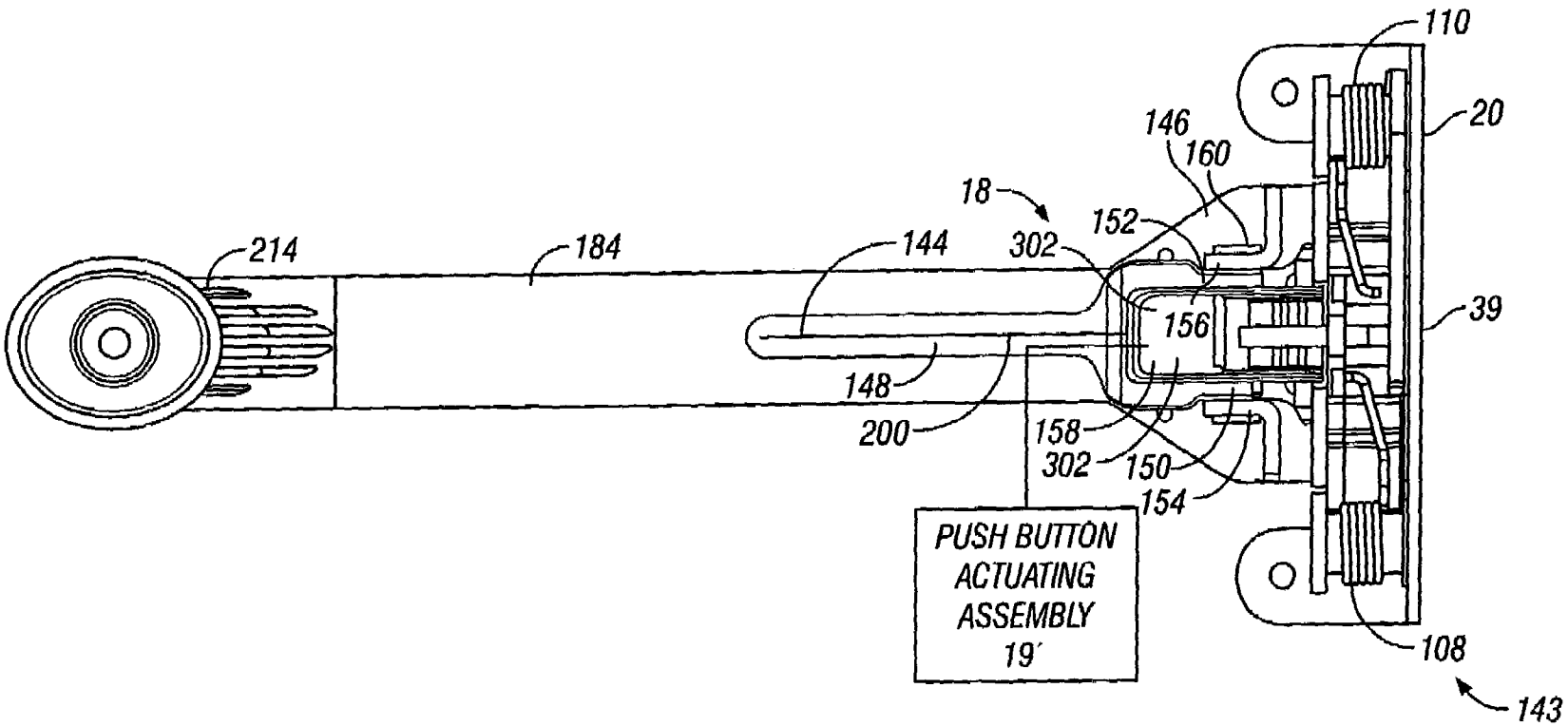
FIG. 11 is a front elevation view of the combined subassembly of FIGS. 9 and 10.
Figure 12:
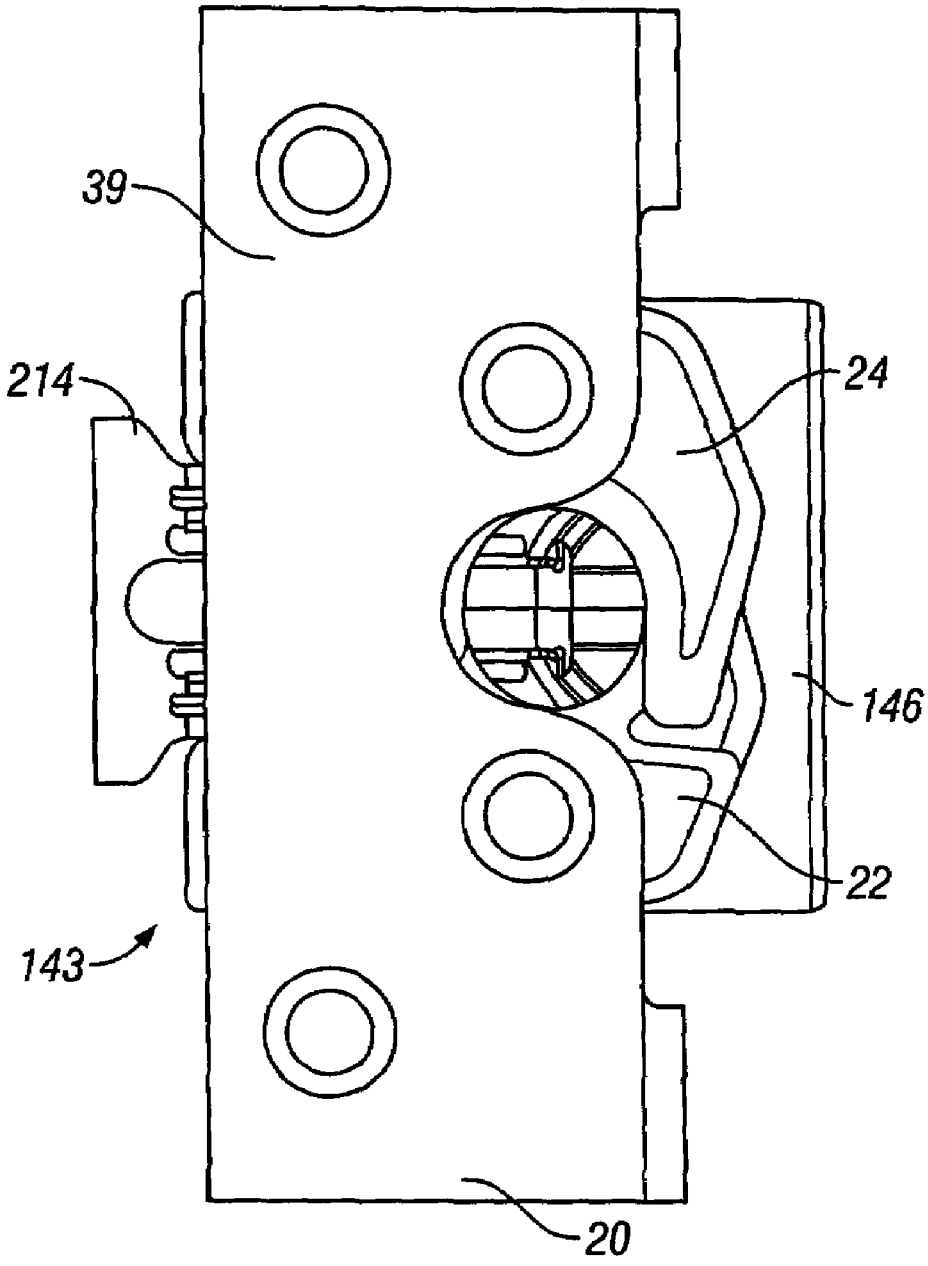
FIG. 12 is an side elevation view of the combined subassembly of FIGS. 9–11.
Figure 13:
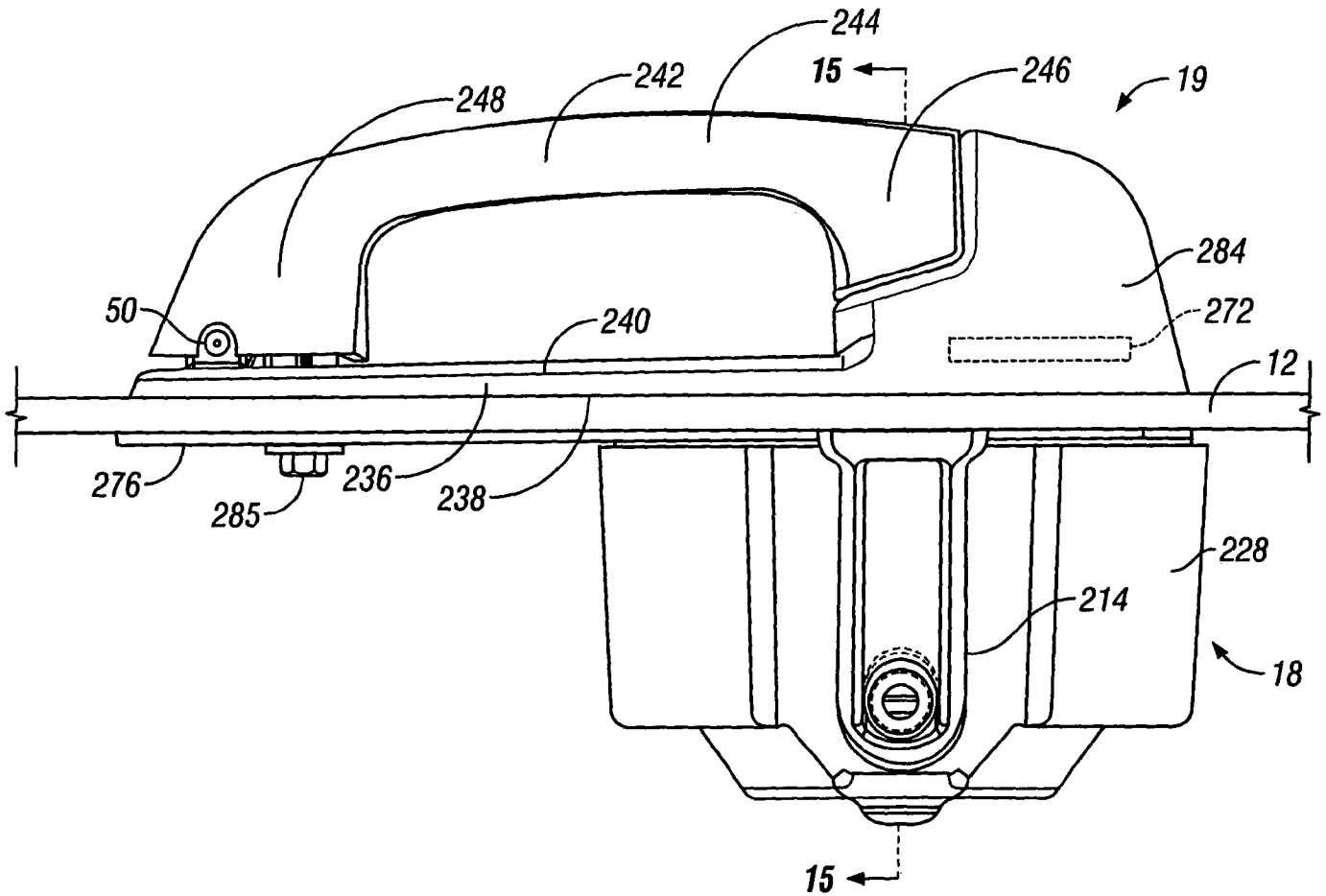
FIG. 13 is a side elevation view of the inventive latch assembly assembled to a section of a movable closure element and with a protective shroud placed over the combined subassembly of FIGS. 9–12.
Figure 15:
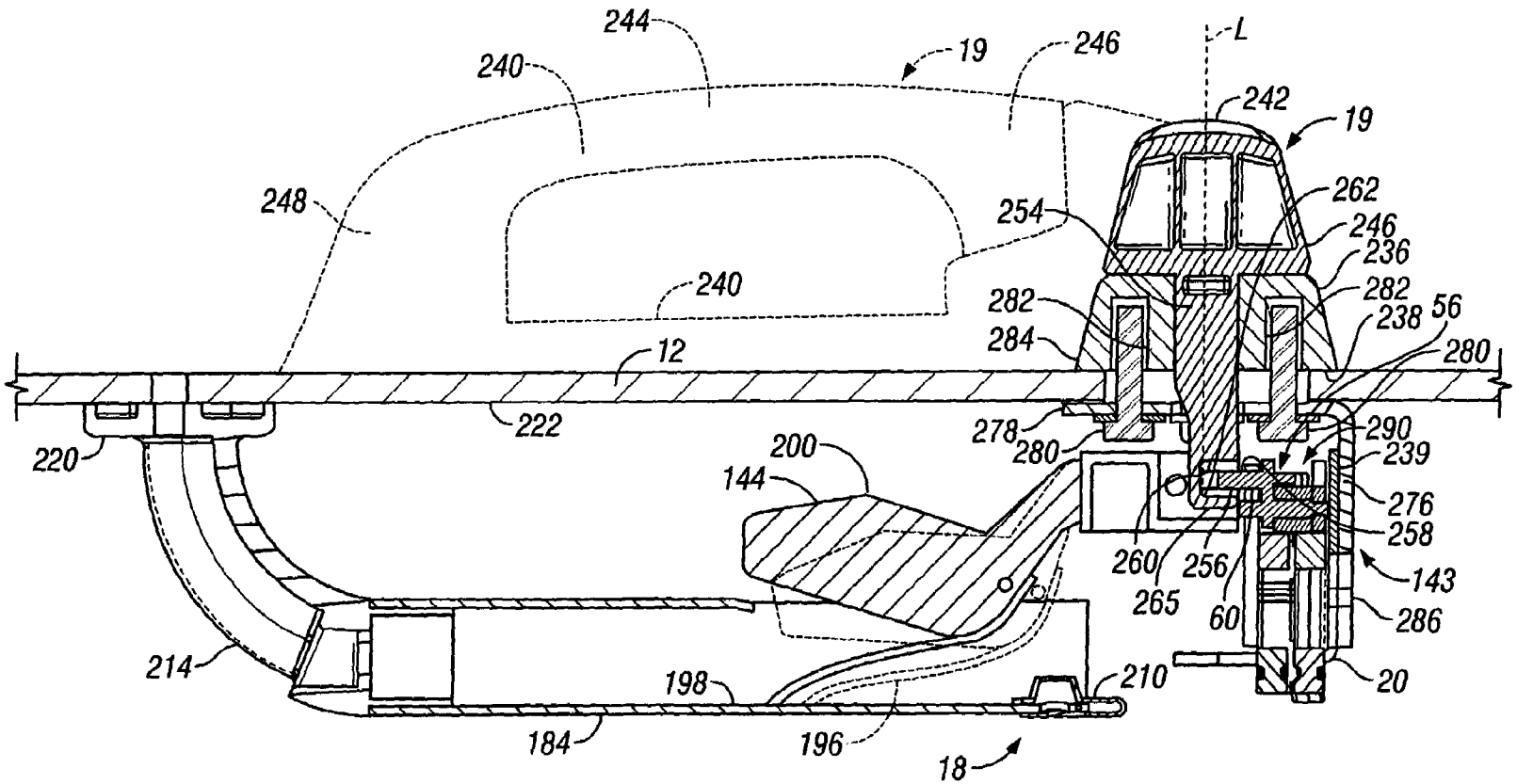
FIG. 15 is a cross-sectional view of the latch assembly taken along line 15—15 of FIG. 13 with the protective shroud removed from the combined subassembly and with one of the actuating subassemblies shown in an alternative mounting orientation in dotted lines.

Details of the second actuating assembly 19 are shown in FIGS. 8, 13, and 15. The second actuating assembly 19 consists of a mounting base 236 defining a flat mounting surface 238 which can be facially placed against the flat, second side 240 of the movable closure element 12. The mounting surface 238 extends over substantially the entire length (L) and width (W) dimension of the mounting base 236. An actuating handle 242 is pivotably attached to the base 236. The actuating handle 242 is U-shaped with a graspable base 244 and spaced first and second legs 246, 248. The leg 248 is pivotably connected to the base 236 through a pin 250 for pivoting movement around an axis 252. Through a spring assembly 253, the actuating handle 242 is urged towards its normal position, as seen in solid lines in each of FIGS. 13, 15 and 17–22. More preferably, once the actuating handle 242 is operated, the biased catch block 58 loads the springs 108, 110 so that the springs 108, 110 urge the catch block 58 in a manner that causes the actuating handle 242 to be moved back towards its normal position, once the actuating force thereon is released. This obviates the need for the spring assembly 253.

The leg 246 has a projecting element/cantilevered connecting element 254 which moves as one piece with the leg 246. The projecting element/cantilevered connecting element 254 projects past the mounting surface 238 and is configured to engage a surface 256 defined by a cantilevered post 258 on the adaptor 60 on the catch block assembly 56. The post 258 is spaced from, and longer than, the post 168.

The projecting element/cantilevered connecting element 254 directly engages the post 258. The projecting element/cantilevered connecting element 254 has an opening 260 formed therein into which the post 258 projects with the second actuating assembly 19 in operative position.

Figure 20:
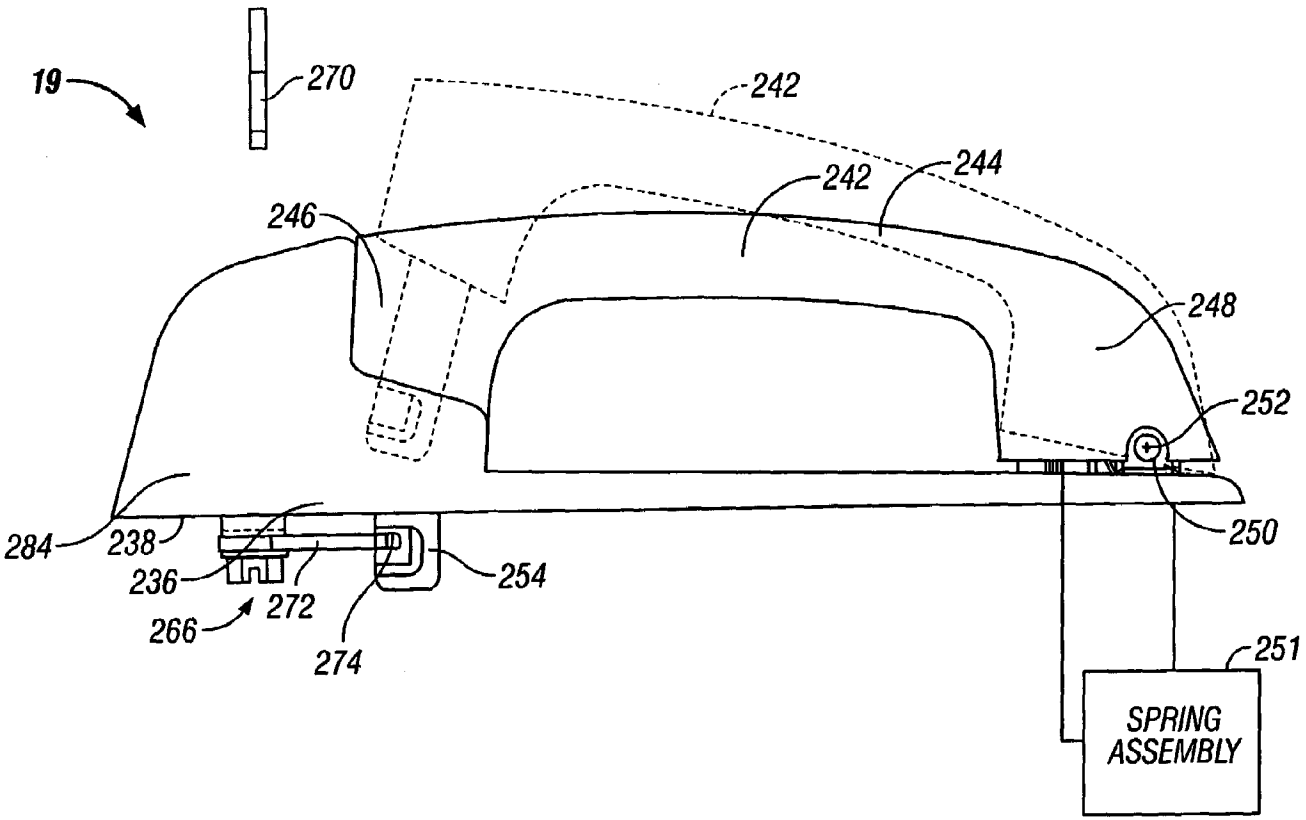
FIG. 20 is a plan view of the second actuating assembly in FIGS. 18 and 19.
Figure 21:
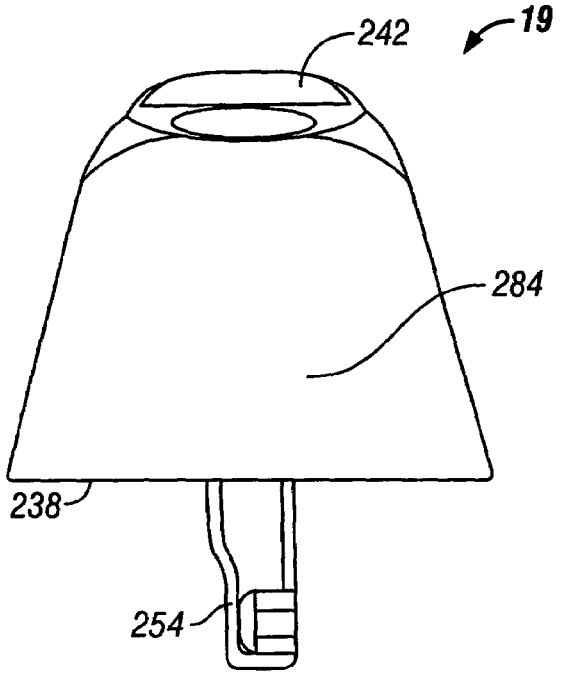
FIG. 21 is a side elevation view of the second actuating assembly in FIGS. 18–20.
Figure 22:
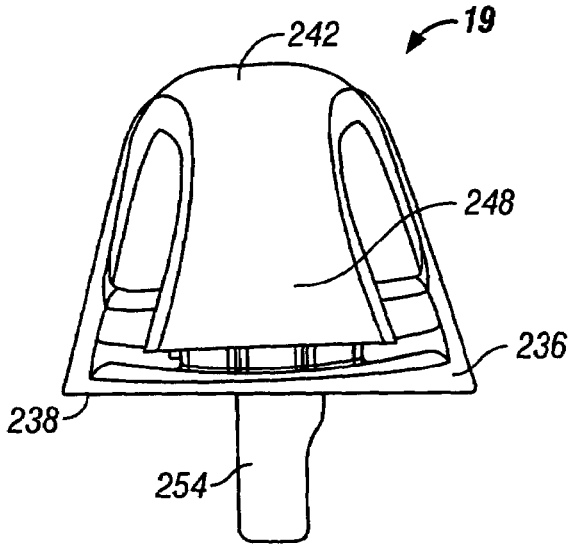
FIG. 22 is an elevation view of the second actuating assembly in FIGS. 18–21 from the side opposite that in FIG. 21.

The actuating handle 242 is changeable between the normal position, shown in FIGS. 13, 15, and 17–22 and a release position, as shown in phantom in FIG. 20 to change the second actuating assembly 19 from a normal state into a release state. As the actuating handle 242 is changed from the normal position into the release position, the shoulder 262 bounding the opening 260 in the projecting element/cantilevered connecting element 254, bears upon the post 258, thereby drawing the catch block assembly 56 in the direction of the arrow 142 so as to thereby change the catch block assembly 56 from its engaged position into its disengaged position. The opening 260 is configured so that the post 258 can be directed thereinto to coact with the shoulder 262 with the first and second actuating assemblies 18, 19 in a range of relative positions without the need for separate fasteners acting between the post 258 and projecting element/cantilevered projecting element 254. More specifically, the first and second actuating assemblies 18, 19 can be relatively repositioned about a line L through the length of the projecting element/cantilevered projecting element 254 through a range of preferably at least 90°. This allows the length of the actuating handle 242 to be oriented selectively horizontally and vertically. This is made possible by forming the opening 262 by cutting out the projecting element/cantilevered connecting element 254 over a substantial portion of its periphery yet while maintaining he free end 265 defining the shoulder 262 rigidly upon the projecting element/cantilevered connecting element 254.

The second actuating assembly 19 has a lock assembly at 266 which has a key operated cylinder 268. By directing a key 270 into the cylinder 268, the cylinder 268 can be rotated to reposition a locking tab 272 between locked and unlocked states. In the locked state, the locking tab 272 is directed into a slot 274 in the projecting element/cantilevered connecting element 254 so as to prevent pivoting of the handle 242 as to draw the projecting element/cantilevered connecting element 254 along the line L to resituate the catch block assembly 56 in the disengaged position.

Figure 14:
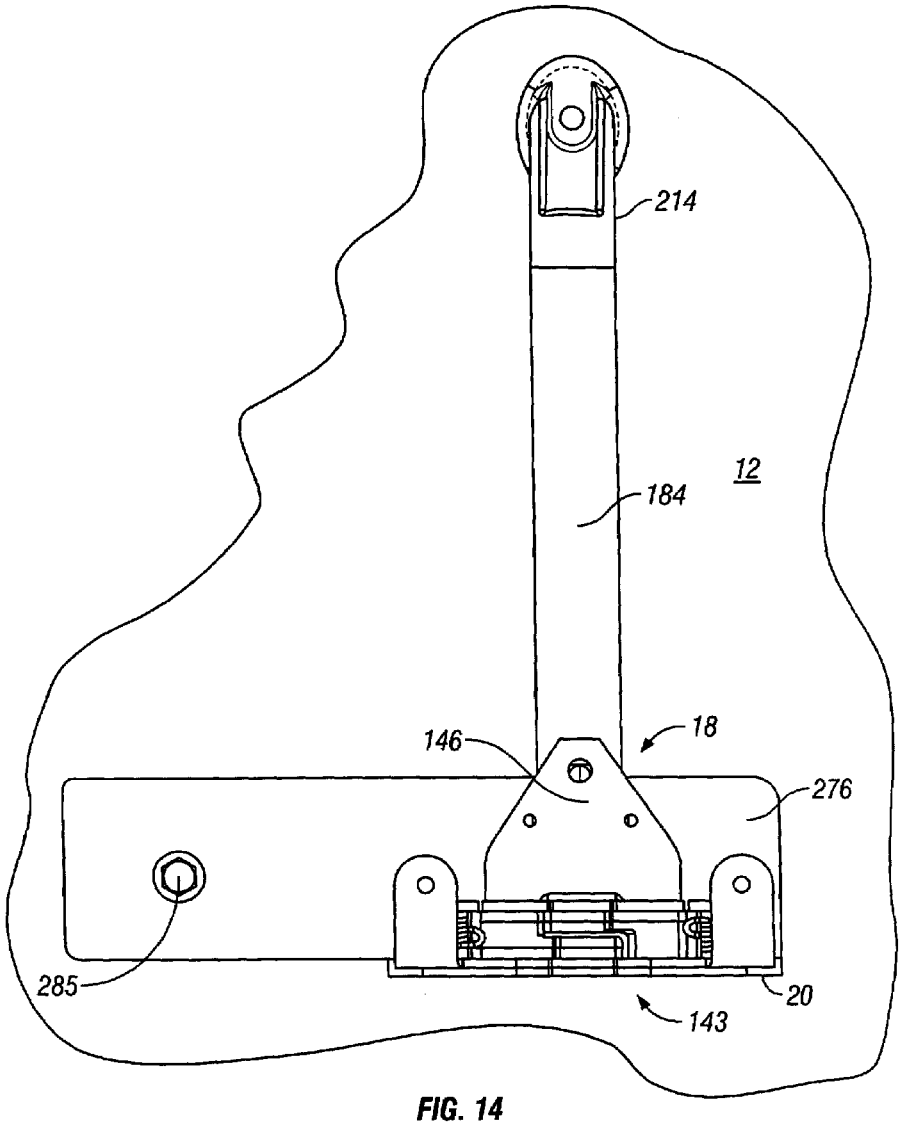
FIG. 14 is a rear elevation view of the combined subassembly in FIGS. 9–12 attached to a section of a movable closure element and with the protective shroud removed.

The first and second actuating assemblies 18, 19 and movable closure element 12 are interconnected through an angled mounting plate 276, as see in FIGS. 8, 14, and 15. The mounting plate 276 has a flat wall 278 which abuts to the movable closure element 12. Mounting bolts 280 are directed through the wall 278 and the movable closure element 12 and into threaded receptacles 282 in an enlarged portion 284 of the mounting base 236. A mounting bolt 285 extends through the mounting plate 276, the movable closure element 12, and into the mounting base 236.

A flat wall 286, orthogonal to the flat wall 278 on the mounting plate 276, is secured to the flat side 239 of the housing 20, either using separate bolts directed through prethreaded bores in the axles 30, 32, 74, 134, or by extending the axles 30, 32, 74, 134 therethrough and conforming the axles 30, 32, 74, 134 therearound. This mounting arrangement creates a space at 290 on the side of the movable closure element 12 at which the first actuating assembly 18 is mounted within which the locking tab 272 can move.

Figure 23:
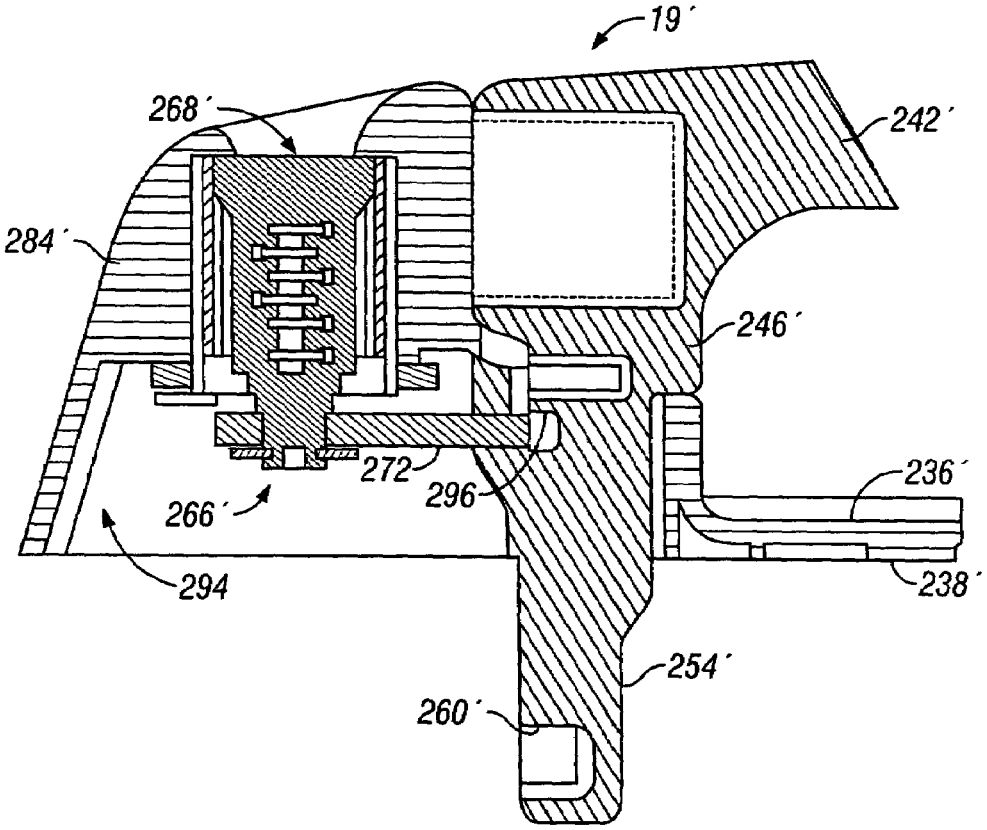
FIG. 23 is a fragmentary, cross-sectional view of a modified form of second actuating assembly with a modified form of locking assembly.

Alternatively, as shown in FIG. 23, the locking tab 272 can be mounted in a recess 294 on a modified form of a second actuating assembly 19', similar to the second actuating assembly 19, and having corresponding parts identified with a "'". The second actuating assembly 19' has a mounting base 236' with a flat mounting surface 238' and an actuating handle 242' pivotably attached to the base 236'. The actuating handle 242' has a leg 246' with a projecting element/cantilevered connecting element 254' with an opening 260' to receive the post 258. The actuating handle 242' has a slot 296 to receive the locking tab in the locked state therefor, as shown in FIG. 23. By rotating a cylinder 268', the tab 272 can be pivoted to an unlocked state, wherein the tab 272 resides outside of the slot 270 so as not to inhibit movement of the actuating handle 242'. This embodiment affords a compact lock assembly 266' within the recess 294 in an enlarged portion 284' of the base 236'.

Figure 16:
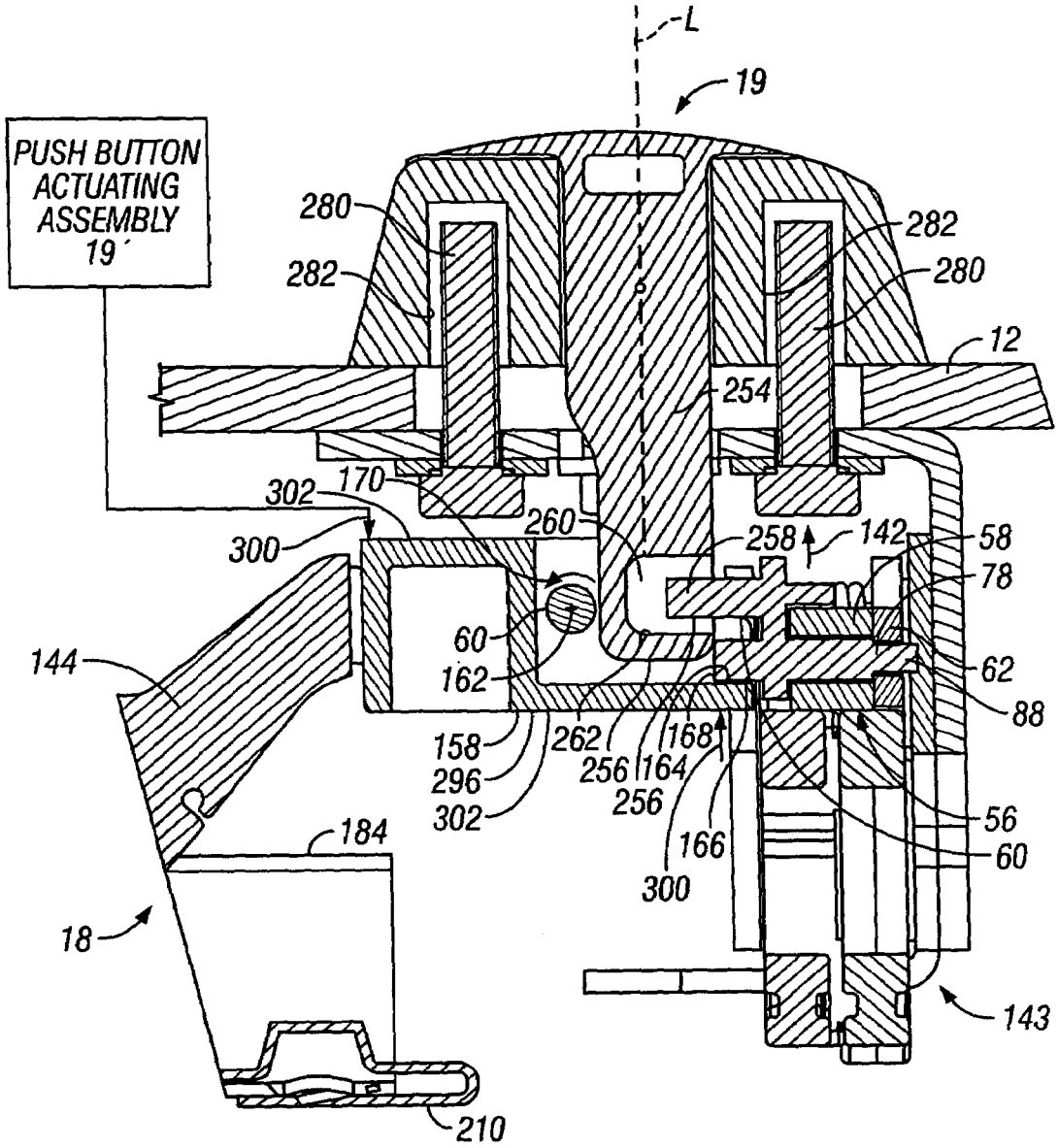
FIG. 16 is an enlarged, fragmentary view of a portion of the latch assembly as shown in cross-section in FIG. 15.
Figure 17:
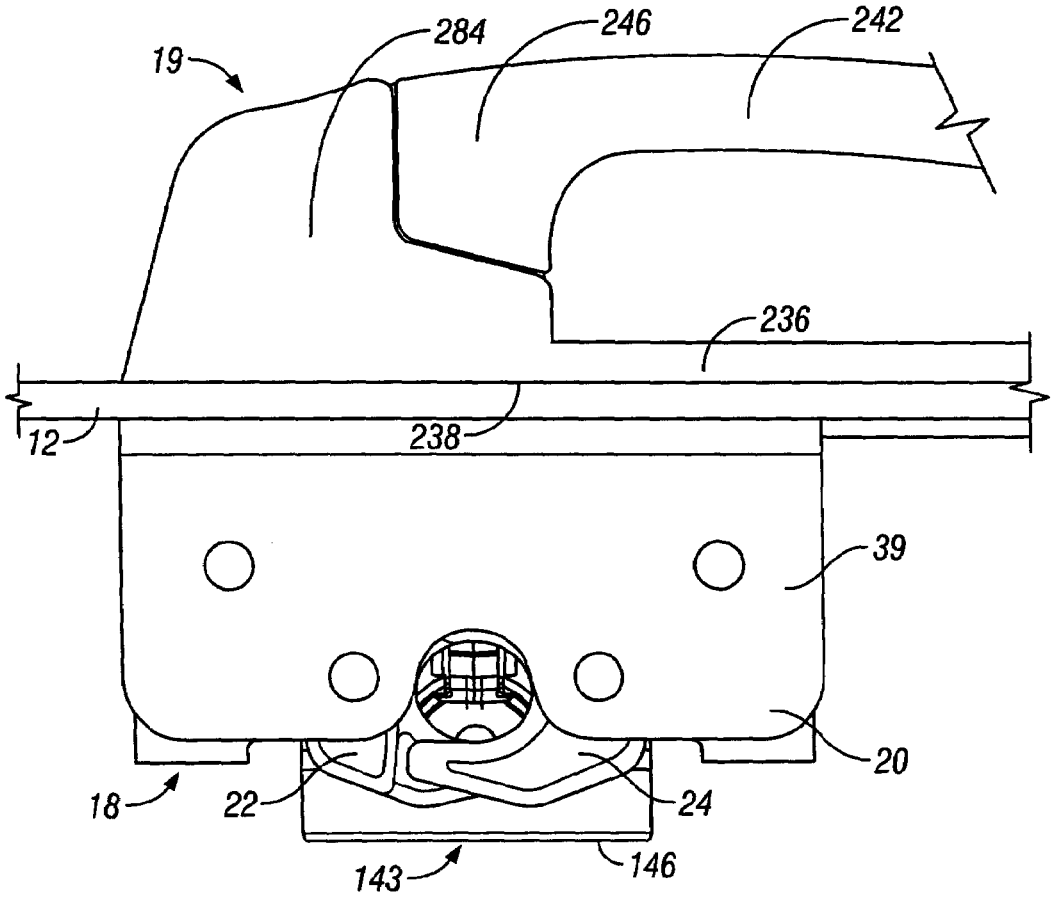
FIG. 17 is a fragmentary, side elevation view of the latch assembly in FIGS. 13–16.
Figure 18:
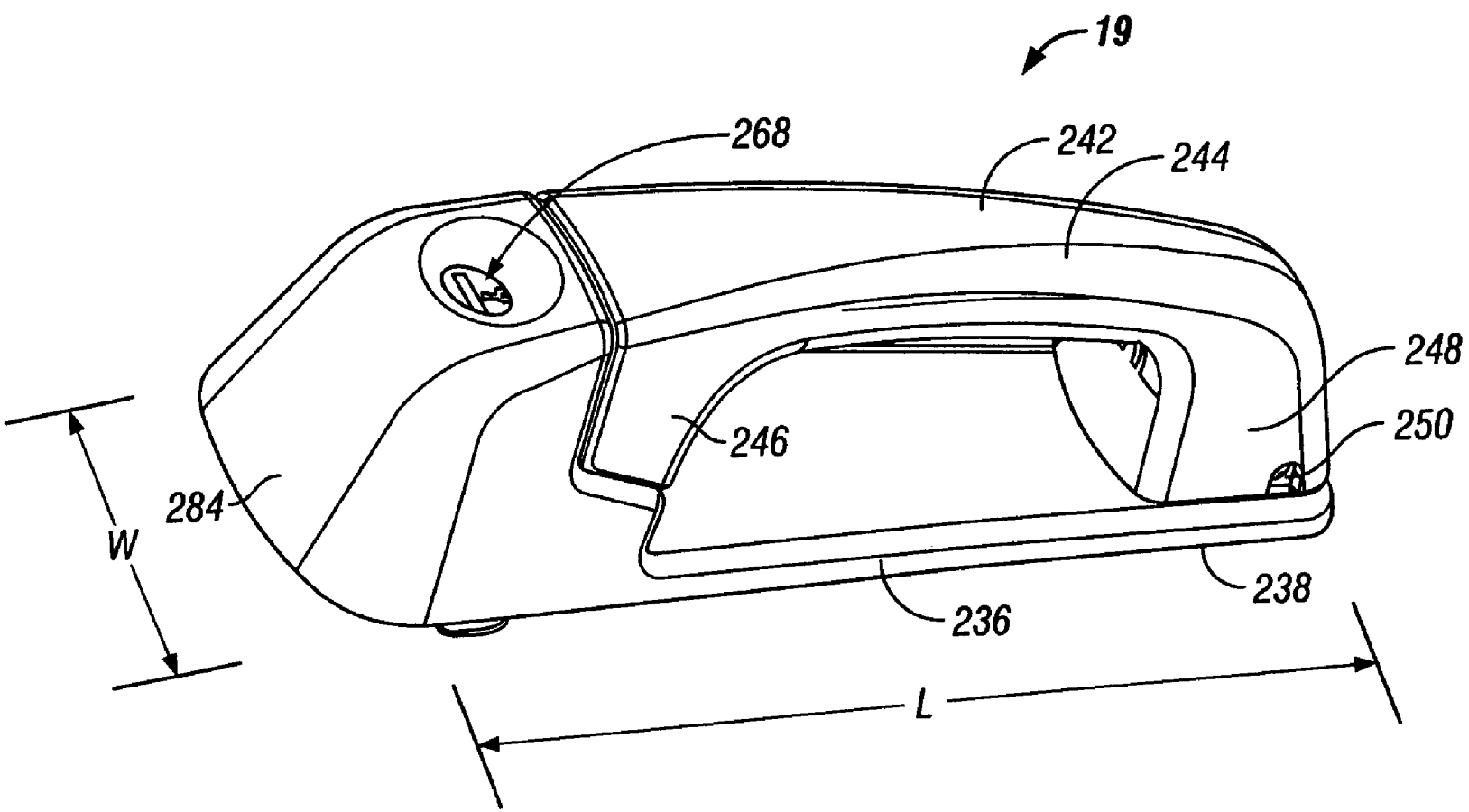
FIG. 18 is a perspective view of a second actuating assembly for placement on the side of a movable closure element opposite that to which the first latch assembly shown in FIGS. 9–12 is located with one form of locking assembly.
Figure 19:
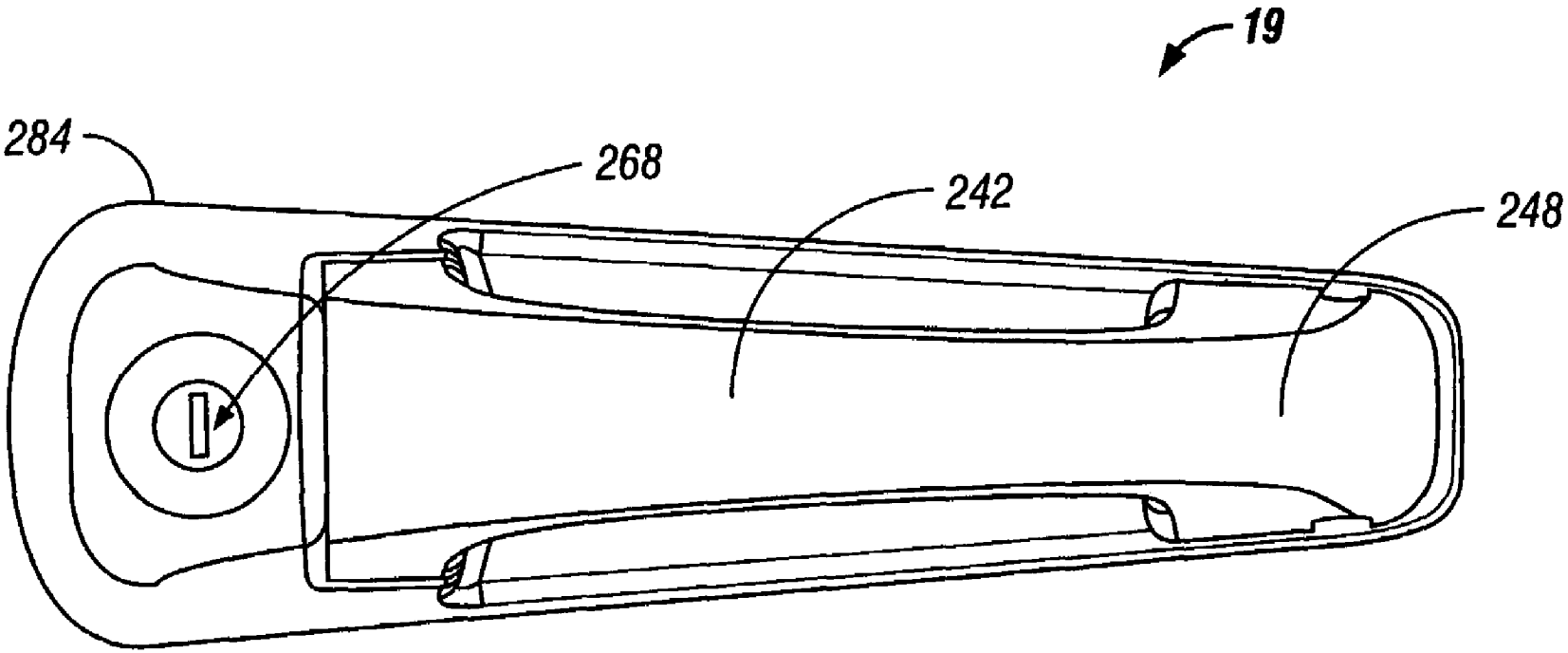
FIG. 19 is a front elevation view of the second actuating assembly in FIG. 18.

As seen in FIGS. 9–11 and 16, the configuration of the trip latch 158 is such that it is pivotable independently of the trip lever 144 around the pin axis 162 to cause the catch assembly 56 to be moved from the engaged position by applying a force in the direction of the arrow 300 on the surface 302 to the left of the pivot axis 162 in FIG. 16. This force can be imparted by a push button actuating assembly 19' that can be used in place of the actuating assembly 19 on the door 12.

Figure 24:
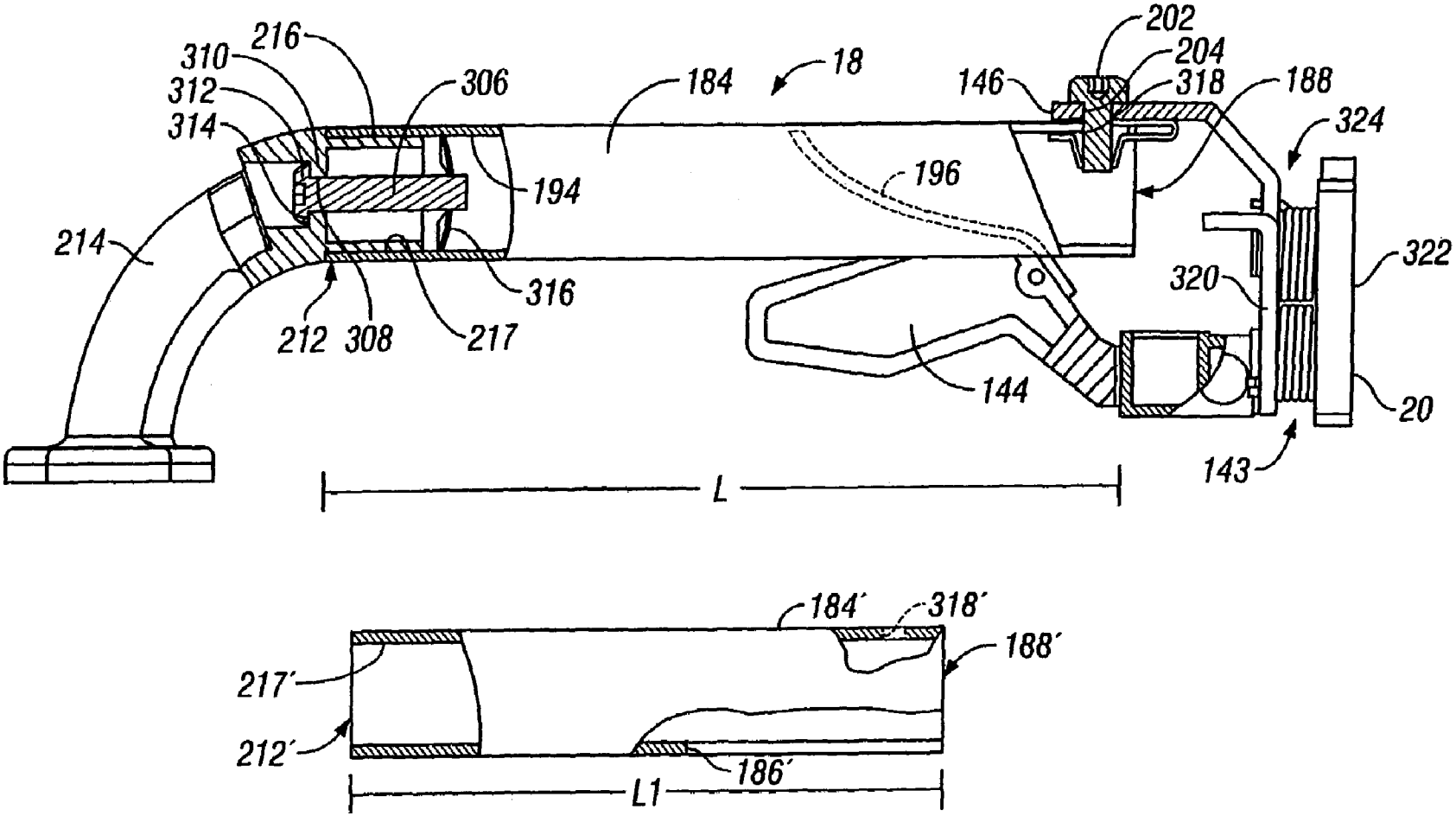
FIG. 24 is a partial cross-sectional, plan view of the combined subassembly of FIGS. 9–12 and showing a separate tubular handle that can be selectively interchanged with the tubular handle that is shown assembled to the latching subassembly.

Another aspect of the invention is the provision of a kit which allows either the manufacturer or end user to select a desired configuration for the first actuating assembly 18, as shown in FIG. 24. The graspable tubular handle 184 shown in FIG. 24 has the length L. As previously explained, the latching subassembly 143 is attached at the one end 188 of the handle 184. The other handle end 212 has a female connecting portion 217 which receives the male connecting portion 216 on the fitting 214. Accordingly, the handle end 212 and fitting 214 can be telescopingly engaged. To maintain the relationship of the telescopingly engaged fitting 214 and tubular handle 184, a threaded fastener 306 is utilized. The threaded fastener 306 is directed through a bore 308 on a wall 310 on the fitting 214 so that a head 312 thereon abuts to an annular surface 314 surrounding the bore 308. The fastener 306 is secured by being threaded into a spring clip 316, which has a shape conforming to, and is wedged in, the hollow 194.

According to the invention, a graspable tubular handle 184', as also shown in FIG. 24, can be used in place of the tubular handle 184. The tubular handle 184' has the same configuration as the tubular handle 184 but has a length L1 that is different than the length L. In this case, the length L1 of the tubular handle 184' is less than the length L of the tubular handle 184. However, the tubular handle 184' could have a length greater than the length L of the tubular handle 184. The tubular handle 184' has ends 188', 212', configured to releasably connect to the fitting 214 and the locking subassembly 143 in the same manner as the same elements attach to the tubular handle 184. That is, the tubular handle 184' has a female connecting portion 217' to accommodate the fitting 214 at the end 212'. At the opposite end 181', the tubular handle 184' has a slot 186' to receive the trip lever 144, and a bore 318 to receive the mounting bolt 202.

Accordingly, the manufacturer/supplier of the actuating assembly 18 may produce fittings 214 and actuating assemblies 143 that are universal in nature and keep on hand tubular handles 184, 184' to cooperate therewith and having a variety of different lengths. The manufacturer may assemble the actuating assembly 18 to order, incorporating the desired graspable tubular handle configuration. Alternatively, the actuating assembly 18 can be sold as a kit including the fitting 214, actuating assembly 143, and a plurality of tubular handles 184, 184' having different lengths which can be selected by the purchaser and assembled on site as conditions may dictate.

Another advantage of the inventive structure, described above, is that the actuating assembly 143 is a self-contained unit which is operable independently of the graspable tubular handles 184, 184'. Accordingly, while the graspable tubular handles 184, 184' facilitate repositioning of the trip lever 144, operation of the latching assembly 143 does not depend upon the presence of the handles 184, 184'. As a result, the latching assembly 143 can be assembled to the tubular handle 184, 184' as a self-contained functioning unit without requiring any special adjustments by reason of joining the latching assembly 143 to the handles 184, 184'.

Additionally, the structure described above facilitates assembly of the latching assembly 143 to the tubular handles 184, 184'. More specifically, the latching assembly 143 can be assembled to the tubular handles 184, 184' by compressing the leaf spring 196 towards the trip lever 144 sufficiently that the tabs 192 and leaf spring 196 can be passed through the ends 188, 188' of the tubular handles 184, 184' and slid lengthwise towards the ends 212, 212' until the bore 204 in the mounting plate 146 aligns with the bore 318 in the handle 184 or a like bore 318' in the handle 184'. The bolt 202 can the be directed through the mounting plage 146 and tubular handles 184, 184' for engagement with the spring clip 210.

The consistent, rigid alignment between the cooperating components can be assured by forming the mounting plate 146 so that one piece thereon defines the tabs 154, 156 and flange 206 and a flat wall 320 on the housing 20. The wall 320, in conjunction with a generally parallel, flat wall 322, bound a space 324 within which the operating components of the latching assembly 143, including the rotors 22, 24 and catch block assembly 56, reside. By directly attaching the trip lever 144 and tubular handles 184, 184' directly to the bracket 146, a consistent and maintainable alignment of components is assured.

The foregoing disclosure of specific embodiments is intended to be illustrative of the broad concepts comprehended by the invention.

The invention claimed is:

1. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle comprising a tubular element having a first length and operatively connectable to at least one of the latching subassembly and actuating assembly in a first manner to facilitate repositioning of the movable closure element upon which the latching subassembly is mounted; and d) a second elongate graspable handle comprising a tubular element having a second length different than the first length and operatively connectable to the at least one of the latching subassembly and actuating assembly in the same manner that the first elongate graspable handle is connectable to the at least one of the latching subassembly and actuating assembly and in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, the first length of the first elongate handle oriented in a first direction relative to the at least one of the latching subassembly and actuating assembly when the first elongate handle is operatively connected to the at least one of the latching subassembly and actuating assembly, the second length of the second elongate handle oriented in the first direction relative to the at least one of the latching subassembly and actuating assembly when the second elongate handle is operatively connected to the at least one of the latching subassembly and actuating assembly, wherein the first and second elongate graspable handles each have spaced first and second ends, the first ends of the first and second elongate graspable handles are each operatively connectable to the at least one of the latching subassembly and actuating assembly, and the kit further comprises a fitting which is connectable to the movable closure element upon which the latching subassembly is mounted and operatively connectable to a) the second end of the first elongate graspable handle when the first elongate graspable handle is operatively connected to the at least one of the latching subassembly and actuating assembly and b) the second end of the second elongate graspable handle when the second elongate handle is operatively connected to the at least one of the latching subassembly and actuating assembly, wherein the fitting is elbow-shaped.

2. The latch assembly kit according to claim 1 wherein the first and second elongate graspable handles each have spaced first and second ends, the first ends of the first and second elongate graspable handles are each operatively connectable to the at least one of the latching subassembly and actuating assembly, and the kit further comprises a fitting which is connectable to the movable closure element upon which the latching subassembly is mounted and operatively connectable to a) the second end of the first elongate graspable handle when the first elongate graspable handle is operatively connected to the at least one of the latching subassembly and actuating assembly and b) the second end of the second elongate graspable handle when the second elongate handle is operatively connected to the at least one of the latching subassembly and actuating assembly.

3. The latch assembly kit according to claim 1 wherein the fitting has a flange to engage and be secured to the movable closure element upon which the latching subassembly is mounted and a connecting portion which is engageable with connecting portions on the second ends of the first and second elongate graspable handles.

4. The latch assembly kit according to claim 1 further comprising a protective shroud that is releasably placed over at least a part of the latching subassembly, the actuating assembly, and a part of the first or second elongate graspable handle that is operatively connected to the at least one of the latching subassembly and actuating assembly.

5. The latch assembly kit according to claim 1 in combination with a movable closure element to which the latching subassembly is mounted.

6. The latch assembly according to claim 5 wherein the closure element has oppositely facing first and second surfaces, the first and second elongate graspable handles are interchangeably mounted at the first surface, the actuating assembly projects from the first surface in a direction away from the second surface, and the first and second tubular elements are each releasably connectable to the actuating assembly where the actuating assembly projects from the first surface, one in place of the other.

7. The latch assembly according to claim 5 wherein the closure element has oppositely facing first and second surfaces, the first and second handles are interchangeably mounted at the first surface so that the first and second lengths of the first and second tubular elements are substantially parallel to the first surface.

8. The latch assembly according to claim 6 wherein the tubular elements have tubular free ends that are connectable to the actuating assembly where the actuating assembly projects from the first surface.

9. The latch assembly according to claim 1 wherein each of the first and second elongate graspable handles is releasably operatively connectable to the at least one of the latching assembly and actuating assembly.

10. The latch assembly according to claim 1 further comprising a first trip lever that is: a) movable relative to the first elongate handle when the first elongate handle is operatively connected to the at least one of the latching subassembly and actuating assembly; and b) movable relative to the second elongate handle when the second elongate handle is operatively connected to the at least one of the latching subassembly and actuating assembly, to thereby change the actuating assembly from the normal state into its release state.

11. The latch assembly according to claim 10 in combination with a movable closure elementto which the latching subassembly is mounted and the first and second elongate handles are each in a fixed position relative to the movable closure element when the first and second elongate handles are operatively connected to the at least one of the latching subassembly and actuating assembly.

12. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle having a first length and operatively connectable to at least one of the latching subassembly and actuating assembly to facilitate repositioning of the movable closure element upon which the latching subassembly is mounted; and d) a second elongate graspable handle having a second length different than the first length and operatively connectable to the at least one of the latching subassembly and actuating assembly in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, wherein the first and second elongate graspable handles each have spaced first and second ends, the first ends of the first and second elongate graspable handles are each operatively connectable to the at least one of the latching subassembly and actuating assembly, and the kit further comprises a fitting which is connectable to the movable closure element upon which the latching subassembly is mounted and operatively connectable to the second ends of the first and second elongate graspable handles, wherein the fitting has a flange to engage and be secured to the movable closure element upon which the latching subassembly is mounted and a connecting portion which is engageable with connecting portions on the second ends of the first and second elongate graspable handles, wherein the connecting portion on the fitting and the connecting portions on the first and second elongate graspable handles are connectable through a telescoping engagement.

13. The latch assembly kit according to claim 12 wherein the connecting portion on the fitting and the connecting portions on the first and second elongate graspable handles are maintainable, telescopingly engaged, one within the other, by a threaded fastener.

14. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle having a first length and operatively connectable to at least one of the latching subassembly and actuating assembly to facilitate repositioning of the movable closure element upon which the latching subassembly is mounted; and d) a second elongate graspable handle having a second length different than the first length and operatively connectable to the at least one of the latching subassembly and actuating assembly in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, wherein the actuating assembly comprises a trip lever that is exposed at the graspable handle that is operatively connected to the at least one of the latching subassembly and actuating assembly, to be engaged by a user and movable between a normal position and a release position to change the actuating assembly from its normal state into its release state.

15. The latch assembly kit according to claim 14 wherein the trip lever is attached directly to the latching subassembly.

16. The latch assembly kit according to claim 15 wherein the trip lever is pivotable between its normal and release positions.

17. The latch assembly kit according to claim 16 wherein the latching subassembly is operable independently of the first and second elongate graspable handles.

18. The latch assembly kit according to claim 17 wherein the first elongate graspable handle has a slot formed thereon to receive the trip lever.

19. The latch assembly kit according to claim 18 wherein the first elongate graspable handle has spaced first and second ends and the trip lever is slidable through the slot from the first end of the first elongate graspable handle towards the second end of the first elongate graspable handle.

20. The latch assembly kit according to claim 19 wherein the first elongate graspable handle is tubular with a wall extending continuously around an internal hollow and the trip lever resides partially within the internal hollow.

21. The latch assembly kit according to claim 20 wherein the wall has an annular, inwardly facing surface and the trip lever has a projecting tab which abuts to the annular, inwardly facing surface on the first elongate graspable handle within the internal hollow to limit pivoting of the trip lever outwardly from the internal hollow.

22. The latch assembly kit according to claim 21 wherein the kit further comprises a spring element acting between the first elongate graspable handle and trip lever to bias the trip lever towards its normal position wherein the spring element abuts to the first elongate graspable handle within the internal hollow.

23. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle having a first length and releasably operatively connectable to at least one of the latching subassembly and actuating assembly to facilitate repositioning of the movable closure element upon which the latching subassembly is mounted; and d) a second elongate graspable handle having a second length different than the first length and releasably operatively connectable to at least one of the latching subassembly and actuating assembly in place of the first elongate graspable handle to facilitate repositioning of the movable closure element upon which the latching subassembly is mounted, wherein the first and second elongate graspable handles can be selectively operatively connected to the at least one of the latching subassembly and actuating assembly to select a desired length of graspable handle to facilitate repositioning of the movable closure element upon which the latching subassembly is mounted, wherein the actuating assembly comprises a trip lever that is movable between a normal position and a release position to change the actuating assembly from its normal state into its release state, wherein the trip lever is attached directly to the latching assembly, wherein the trip lever is pivotable between its normal and release positions, wherein the latching subassembly is operable independently of the first and second elongate graspable handles, wherein the first elongate graspable handle has a slot formed thereon to receive the trip lever, wherein the first elongate graspable handle has spaced first and second ends and the trip lever is slidable through the slot from the first end of the first elongate graspable handle towards the second end of the first elongate graspable handle, wherein the first elongate graspable handle is tubular with an internal hollow and the trip lever resides partially within the internal hollow, wherein the trip lever has a projecting tab which abuts to the first elongate graspable handle within the internal hollow to limit pivoting of the trip lever outwardly from the internal hollow, wherein the kit further comprises a spring element acting between the first elongate graspable handle and trip lever to bias the trip lever towards its normal position wherein the projecting tab abuts to the first elongate graspable handle within the internal hollow, wherein the spring element comprises a leaf spring.

24. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle having a first length and releasably operatively connectable to at least one of the latching subassembly and actuating assembly to facilitate repositioning of the movable closure element upon which the latching subassembly is mounted; and d) a second elongate graspable handle having a second length different than the first length and releasably operatively connectable to at least one of the latching subassembly and actuating assembly in place of the first elongate graspable handle to facilitate repositioning of the movable closure element upon which the latching subassembly is mounted, wherein the first and second elongate graspable handles can be selectively operatively connected to the at least one of the latching subassembly and actuating assembly to select a desired length of graspable handle to facilitate repositioning of the movable closure element upon which the latching subassembly is mounted, wherein the actuating assembly comprises a trip lever that is movable between a normal position and a release position to change the actuating assembly from its normal state into its release state, wherein the trip lever is attached directly to the latching assembly, wherein the trip lever is pivotable between its normal and release positions, wherein the latching subassembly is operable independently of the first and second elongate graspable handles, wherein the first elongate graspable handle has a slot formed thereon to receive the trip lever, wherein the first elongate graspable handle has spaced first and second ends and the trip lever is slidable through the slot from the first end of the first elongate graspable handle towards the second end of the first elongate graspable handle, wherein the first elongate graspable handle is tubular with an internal hollow and the trip lever resides partially within the internal hollow, wherein the kit further comprises a leaf spring attached to the trip lever so that the trip lever and attached leaf spring can be slid through the first end of the first elongate graspable handle into an operative position wherein the leaf spring resides within the hollow and acts between the first elongate graspable handle and the trip lever so that the trip lever is urged by the leaf spring towards its normal position.

25. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle comprising a tubular element having a first length and operatively connectable to at least one of the latching subassembly and actuating assembly in a first manner to facilitate repositioning of the movable closure element upon which the latching subassembly is mounted; and d) a second elongate graspable handle comprising a tubular element having a second length different than the first length and operatively connectable to the at least one of the latching subassembly and actuating assembly in the same manner that the first elongate graspable handle is connectable to the at least one of the latching subassembly and actuating assembly and in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, the first length of the first elongate handle oriented in a first direction relative to the at least one of the latching subassembly and actuating assembly when the first elongate handle is operatively connected to the at least one of the latching subassembly and actuating assembly, the second length of the second elongate handle oriented in the first direction relative to the at least one of the latching subassembly and actuating assembly when the second elongate handle is operatively connected to the at least one of the latching subassembly and actuating assembly, wherein the latching subassembly comprises a housing and a pivotable rotor with a receptacle movable relative to the housing selectively between a) a latched position and b) a release position, the first rotor releasably engageable with a strike element with the rotor in the latched position wherein the strike element resides within the receptacle.

26. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle comprising a tubular element having a first length and operatively connectable to at least one of the latching subassembly and actuating assembly in a first manner to facilitate repositioning of the movable closure element upon which the latching subassembly is mounted; and d) a second elongate graspable handle comprising a tubular element having a second length different than the first length and operatively connectable to the at least one of the latching subassembly and actuating assembly in the same manner that the first elongate graspable handle is connectable to the at least one of the latching subassembly and actuating assembly and in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, the first length of the first elongate handle oriented in a first direction relative to the at least one of the latching subassembly and actuating assembly when the first elongate handle is operatively connected to the at least one of the latching subassembly and actuating assembly, the second length of the second elongate handle oriented in the first direction relative to the at least one of the latching subassembly and actuating assembly when the second elongate handle is operatively connected to the at least one of the latching subassembly and actuating assembly, wherein the latching subassembly comprises a housing with spaced walls bounding a space and a rotor within the space for releasably engaging a strike element, the kit further comprises a bracket which defines at least a part of one of the walls bounding the space, the first and second elongate graspable handles each have spaced ends, and one of the spaced ends of the first and second elongate graspable handles is attachable directly to the bracket.

27. The latch assembly kit according to claim 26 wherein the actuating assembly comprises a trip lever that is pivotable between a normal position and a release position to change the actuating assembly from its normal state into its release state.

28. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle having a first length and operatively connectable to at least one of the latching subassembly and actuating assembly to facilitate repositioning of the movable closure element upon which the latching subassembly is mounted; and d) a second elongate graspable handle having a second length different than the first length and operatively connectable to the at least one of the latching subassembly and actuating assembly in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, wherein the latching subassembly comprises a housing with spaced walls bounding a space and a rotor within the space for releasably engaging a strike element, the kit further comprises a bracket which defines at least a part of one of the walls bounding the space, the first and second elongate graspable handles each have spaced ends, and one of the spaced ends of the first and second elongate graspable handles is attachable directly to the bracket, wherein the actuating assembly comprises a trip lever that is pivotable between a normal position and a release position to change the actuating assembly from its normal state into its release state, wherein the trip lever is connected directly to the bracket for guided pivoting movement between its normal position and its release position.

29. The latch assembly kit according to claim 28 wherein the bracket has one piece that defines the at least part of the one of the walls bounding the space and to which the trip lever and the one of the spaced ends of the first and second elongate graspable handles directly attach.

30. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length and mountable to the movable closure element to be fully surrounded and grasped by the hand of a user to facilitate repositioning of the movable closure element upon which the latching subassembly is mounted, wherein the actuating assembly comprises a trip lever that is attached to the latching subassembly and exposed to be engaged by a hand of a user that is grasping and surrounding the elongate graspable handle to be moved relative to the elongate graspable handle between normal and release positions to thereby cause the latching subassembly to be changed from its latched state into its release state, wherein the trip lever is pivotable between its normal and release positions.

31. The latch assembly according to claim 30 further comprising a protective shroud that is releasably placed over at least a part of the latching assembly.

32. The latch assembly according to claim 30 in combination with a movable closure element to which the latching subassembly is mounted, the elongate graspable handle spaced from the movable closure element to allow a user's hand that is grasping the elongate graspable handle to reside between the elongate graspable handle and movable closure element.

33. The latch assembly according to claim 30 wherein the elongate graspable handle has a lengthwise axis and the trip lever is movable between the normal and release position by moving at least a part of the trip lever toward the lengthwise axis.

34. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length to be surrounded and grasped by the hand of a user to facilitate repositioning of the movable closure element upon which the latching subassembly is mounted, wherein the actuating assembly comprises a trip lever that is attached to the latching subassembly and exposed to be engaged by a user to be moved relative to the elongate graspable handle between normal and release positions to thereby cause the latching subassembly to be changed from its latched state into its release state, wherein the trip lever is pivotable between its normal and release positions, wherein the elongate graspable handle comprises a tubular element.

35. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length to be surrounded and grasped by the hand of a user to facilitate repositioning of the movable closure element upon which the latching subassembly is mounted, wherein the actuating assembly comprises a trip lever that is attached to the latching subassembly and exposed to be engaged by a user to be moved relative to the elongate graspable handle between normal and release positions to thereby cause the latching subassembly to be changed from its latched state into its release state, wherein the elongate graspable handle comprises a tubular element, wherein the elongate graspable handle has spaced first and second ends, the first end of the elongate graspable handle is connected to the at least one of the latching subassembly and actuating assembly, and the latch assembly further comprises a fitting which is connectable to the movable closure element upon which the latching subassembly is mounted and operatively connected to the second end of the elongate graspable handle to mount the second end of the elongate graspable handle fixedly relative to a movable closure element.

36. The latch assembly according to claim 35 wherein the fitting is elbow-shaped.

37. The latch assembly according to claim 36 wherein the fitting has a flange to engage and be secured to the movable closure element upon which the latching subassembly is mounted and a connecting portion which engages a connecting portion on the second end of the elongate graspable handle.

38. The latch assembly according to claim 37 wherein the connecting portion on the fitting and the connecting portion on the elongate graspable handle are connected through a telescoping engagement.

39. The latch assembly according to claim 38 wherein the connecting portion on the fitting and the connecting portion on the elongate graspable handle are maintained, telescopingly engaged, one within the other, by a threaded fastener.

40. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length to be surrounded and grasped by the hand of a user to facilitate repositioning of the movable closure element upon which the latching subassembly is mounted, wherein the actuating assembly comprises a trip lever that is attached to the latching subassembly and exposed to be engaged by a user to be moved relative to the elongate graspable handle between normal and release positions to thereby cause the latching subassembly to be changed from its latched state into its release state, wherein the trip lever is pivotable between its normal and release positions, wherein the trip lever is pivotable between a normal position and a release position to change the actuating assembly from its normal state into its release state.

41. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle comprising a tubular element having a first length and operatively connectable to at least one of the latching subassembly and actuating assembly in a first manner to facilitate repositioning of the movable closure element upon which the latching subassembly is mounted; and d) a second elongate graspable handle comprising a tubular element having a second length different than the first length and operatively connectable to the at least one of the latching subassembly and actuating assembly in the same manner that the first elongate graspable handle is connectable to the at least one of the latching subassembly and actuating assembly and in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, the first length of the first elongate handle oriented in a first direction relative to the at least one of the latching subassembly and actuating assembly when the first elongate handle is operatively connected to the at least one of the latching subassembly and actuating assembly, the second length of the second elongate handle oriented in the first direction relative to the at least one of the latching subassembly and actuating assembly when the second elongate handle is operatively connected to the at least one of the latching subassembly and actuating assembly, wherein the actuating assembly comprises a trip lever that is attached directly to the latching subassembly.

42. The latch assembly according to claim 41 wherein the trip lever is pivotable between its normal and release positions.

43. The latch assembly according to claim 42 wherein the latching subassembly is operable independently of the elongate graspable handle.

44. A latch assembly comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle having a first length and operatively connectable to at least one of the latching subassembly and actuating assembly to facilitate repositioning of the movable closure element upon which the latching subassembly is mounted; and d) a second elongate graspable handle having a second length different than the first length and operatively connectable to the at least one of the latching subassembly and actuating assembly in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, wherein the actuating assembly comprises a trip lever that is attached directly to the latching subassembly, wherein the trip lever is pivotable between normal and release positions to thereby change the actuating assembly from its normal state into its release state, wherein the latching subassembly is operable independently of the elongate graspable handle, wherein the elongate graspable handle has a slot formed thereon to receive the trip lever.

45. The latch assembly according to claim 44 wherein the elongate graspable handle has spaced first and second ends and the trip lever is slidable through the slot from the first end of the elongate graspable handle towards the second end of the elongate graspable handle.

46. The latch assembly according to claim 45 wherein the elongate graspable handle is tubular with a wall extending continuously around an internal hollow and the trip lever resides partially within the internal hollow.

47. The latch assembly according to claim 46 wherein the wall has an annular, inwardly facing surface and the trip lever has a projecting tab which abuts to the annular, inwardly facing surface on the elongate graspable handle within the internal hollow to limit pivoting of the trip lever outwardly from the internal hollow.

48. The latch assembly according to claim 47 wherein the latch assembly further comprises a spring element acting between the elongate graspable handle and trip lever to bias the trip lever towards its normal position wherein the projecting tab abuts to the elongate graspable handle within the internal hollow.

49. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly to facilitate repositioning of the movable closure element upon which the latching subassembly is mounted, wherein the actuating assembly comprises a trip lever that is attached to the latching subassembly for movement between normal and release positions, wherein the trip lever is attached directly to the latching subassembly, wherein the trip lever is pivotable between its normal and release positions, wherein the latching subassembly is operable independently of the elongate graspable handle, wherein the elongate graspable handle has a slot formed thereon to receive the trip lever, wherein the elongate graspable handle has spaced first and second ends and the trip lever is slidable through the slot from the first end of the elongate graspable handle towards the second end of the elongate graspable handle, wherein the elongate graspable handle is tubular with a internal hollow and the grip lever resides partially within the internal hollow, wherein the trip lever has a projecting tab which abuts to the elongate graspable handle within the internal hollow to limit pivoting of the trip lever outwardly from the internal hollow, wherein the latch assembly further comprises a spring element acting between the elongate graspable handle and trip lever to bias the trip lever towards its normal position wherein the projecting tab abuts to the elongate graspable handle within the internal hollow, wherein the spring element comprises a leaf spring.

50. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly to facilitate repositioning of the movable closure element upon which the latching subassembly is mounted, wherein the actuating assembly comprises a trip lever that is attached to the latching subassembly for movement between normal and release positions, wherein the trip lever is attached directly to the latching subassembly, wherein the trip lever is pivotable between its normal and release positions, wherein the latching subassembly is operable independently of the elongate graspable handle, wherein the elongate graspable handle has a slot formed thereon to receive the trip lever, wherein the elongate graspable handle has spaced first and second ends and the trip lever is slidable through the slot from the first end of the elongate graspable handle towards the second end of the elongate graspable handle, wherein the elongate graspable handle is tubular with a internal hollow and the grip lever resides partially within the internal hollow, wherein the latch assembly further comprises a leaf spring attached to the trip lever so that the trip lever and attached leaf spring can be slid through the first end of the elongate graspable handle into an operative position wherein the leaf spring resides within the hollow and acts between the elongate graspable handle and the trip lever so that the trip lever is urged by the leaf spring towards its normal position.

51. A latch assembly for a movable closure element, the latch assembly comprising:

a latching subassembly for mounting upon a movable closure element the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length to be surrounded and grasped by the hand of a user to facilitate repositioning of the movable closure element upon which the latching subassembly is mounted, wherein the actuating assembly comprises a trip lever that is attached to the latching subassembly and exposed to be engaged by a user to be moved relative to the elongate graspable handle between normal and release positions to thereby cause the latching subassembly to be changed from its latched state into its release state, wherein the latching subassembly comprises a housing and a pivotable rotor with a receptacle movable relative to the housing selectively between a) a latched position and b) a release position, the first rotor releasably engageable with a strike element with the rotor in its latched position wherein the strike element resides within the receptacle.

52. A latch assembly for a movable closure element, the latch assembly comprising:

a latching assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length to be surrounded and grasped by the hand of a user to facilitate repositioning of the movable closure element upon which the latching subassembly is mounted, wherein the actuating assembly comprises a trip lever that is attached to the latching subassembly and exposed to be engaged by a user to be moved relative to the elongate graspable handle between normal and release positions to thereby cause the latching subassembly to be changed from its latched state into its release state, wherein the trip lever is pivotable between its normal and release positions, wherein the latching subassembly comprises a housing with spaced walls bounding a space and a rotor within the space for releasably engaging a strike element, the latch assembly further comprising a bracket which defines at least a part of one of the walls bounding the space, the elongate graspable handle having spaced ends, and one of the spaced ends of the elongate graspable handle is attached directly to the bracket.

53. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length to be surrounded and grasped by the hand of a user to facilitate repositioning of the movable closure element upon which the latching subassembly is mounted, wherein the actuating assembly comprises a trip lever that is attached to the latching subassembly and exposed to be engaged by a user to be moved relative to the elongate graspable handle between normal and release positions to thereby cause the latching subassembly to be changed from its latched state into its release state, wherein the latching subassembly comprises a housing with spaced walls bounding a space and a rotor within the space for releasably engaging a strike element, the latch assembly further comprises a bracket which defines at least a part of the walls bounding the space, the elongate handle having spaced ends, and one of the spaced ends of the elongate graspable handle is attached directly to the bracket, wherein the actuating assembly comprises a trip lever that is pivotable between a normal position and a release position to change the actuating assembly from its normal state into its release state.

54. The latch assembly according to claim 53 wherein the trip lever is connected directly to the bracket for guided pivoting movement between its normal position and its release position.

55. The latch assembly according to claim 54 wherein the bracket has one piece that defines the at least part of the one of the walls bounding the space and to which the trip lever and the one of the spaced ends of the first elongate graspable handle directly attach.

56. A latch assembly kit comprising:

a) a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

b) an actuating assembly having a normal state and a release state, the actuating assembly causing the latching subassembly to change from its latched state into its release state as an incident of the actuating assembly changing from its normal state into its release state, c) a first elongate graspable handle comprising a tubular element having a first length and operatively connectable to at least one of the latching subassembly and actuating assembly in a first manner to facilitate repositioning of the movable closure element upon which the latching subassembly is mounted;

d) a second elongate graspable handle comprising a tubular element having a second length different than the first length and operatively connectable to the at least one of the latching subassembly and actuating assembly in the same manner that the first elongate graspable handle is connectable to the at least one of the latching subassembly and actuating assembly and in place of the first elongate graspable handle to facilitate repositioning of the movable closure element upon which the latching subassembly is mounted, wherein the first and second elongate graspable handles can be selectively operatively connected, one in place of the other, to the at least one of the latching subassembly and actuating assembly to select a desired length of graspable handle to facilitate repositioning of the movable closure element upon which the latching subassembly is mounted, the first length of the first elongate handle oriented in a first direction relative to the at least one of the latching subassembly and actuating assembly when the first elongate handle is operatively connected to the at least one of the latching subassembly and actuating assembly, the second length of the second elongate handle oriented in the first direction relative to the at least one of the latching subassembly and actuating assembly when the second elongate handle is operatively connected to the at least one of the latching subassembly and actuating assembly, a first trip lever that is: a) movable relative to the first elongate handle when the first elongate handle is operatively connected to the at least one of the latching subassembly and actuating assembly; and b) movable relative to the second elongate handle when the second elongate handle is operatively connected to the at least one of the latching subassembly and actuating assembly, to thereby change the actuating assembly from the normal state into its release state, said latch assembly provided in combination with a movable closure element to which the latching subassembly is mounted and the first and second elongate handles are each in a fixed position relative to the movable closure element when the first and second elongate handles are operatively connected to the at least one of the latching subassembly and actuating assembly, wherein the trip lever is movable by a finger of a hand that is grasping the first elongate handle when the first elongate handle is operatively connected to the at least one of the latching subassembly and actuating assembly.

57. A latch assembly for a movable closure element, the latch assembly comprising:

a latching subassembly for mounting upon a movable closure element, the latching subassembly having i) a latched state wherein the latching subassembly releasably engages a strike element to maintain the movable closure element in a desired position relative to a support to which the movable closure element is attached, and ii) a release state;

an actuating assembly having a normal state and a release state, the actuating assembly causing the latching subassembly to change from its latched state into its release state as an incident of the actuating assembly changing from its normal state into its release state; and an elongate graspable handle connected to at least one of the latching subassembly and actuating assembly and having a sufficient length and mountable to the movable closure element to be fully surrounded and grasped by the hand of a user to facilitate repositioning of the movable closure element upon which the latching subassembly is mounted, wherein the actuating assembly comprises a trip lever that is attached to the latching subassembly and exposed to be engaged by a hand of a user that is grasping and surrounding the elongate graspable handle to be moved relative to the elongate graspable handle between normal and release positions to thereby cause the latching subassembly to be changed from its latched state into its release state, wherein the trip lever is pivotable relative to the elongate graspable handle between the normal and release positions.

* * * * *